US010667589B2

(12) United States Patent
Fathollahi et al.

(10) Patent No.: US 10,667,589 B2
(45) Date of Patent: Jun. 2, 2020

(54) MOBILE DEVICE CASES AND CASE SYSTEM WITH EMBEDDED SIDEWALL SHOCK ABSORBER

(71) Applicant: Incipio, LLC, Irvine, CA (US)

(72) Inventors: Andy Fathollahi, Corona Del Mar, CA (US); Peter Tu, Long Beach, CA (US)

(73) Assignee: Incipio, LLC, Irvine, CA (US)

( * ) Notice: Subject to any disclaimer, the term of this patent is extended or adjusted under 35 U.S.C. 154(b) by 234 days.

(21) Appl. No.: 15/208,574

(22) Filed: Jul. 12, 2016

(65) Prior Publication Data

US 2017/0013925 A1 Jan. 19, 2017

Related U.S. Application Data

(60) Provisional application No. 62/192,030, filed on Jul. 13, 2015.

(51) Int. Cl.
*A45C 13/02* (2006.01)
*A45C 11/00* (2006.01)

(52) U.S. Cl.
CPC ..... *A45C 13/02* (2013.01); *A45C 2011/001* (2013.01); *A45C 2011/002* (2013.01); *A45C 2011/003* (2013.01); *A45C 2200/10* (2013.01)

(58) Field of Classification Search
CPC ..... A45C 13/02; A45C 2011/001; A45C 2011/002; A45C 2011/003;
(Continued)

(56) References Cited

U.S. PATENT DOCUMENTS 9,155,367 B2 10/2015 Fathollahi et al.
9,281,858 B2 3/2016 Fathollahi
(Continued)

OTHER PUBLICATIONS

Supcase iPhone 6 Plus Cases, printed from webpage: http://www.supcase.com/iphone-6-plus-cases.html on Feb. 15, 2017.
Spigen iPhone 6 Smart Protection with Style, printed from webpage: http://www.spigen.com/collections/iphone-6 on Feb. 15, 2017.
Pelican Phone & Tablet, printed from webpage: http://www.pelican.com/us/en/products/phone-cases/ on Feb. 15, 2017.

*Primary Examiner* — Anthony D Stashick
*Assistant Examiner* — James M Van Buskirk

(57) ABSTRACT

Protective cases and case systems for a mobile device are disclosed. The cases include a multi component structure that defines a compartment that is dimensioned to receive a mobile device and includes one or more shock absorber elements embedded within its side walls. The multi-component construct may be configured as a standalone case or sleeve that reversibly fits within another external component or shell. The shock absorber element may be formed in multiple segments and may be formed of a softer material than adjacent regions of the case and co-molded into a channel in a supporting wall component that is formed of a more rigid material. The shock absorber component may have one or more channels formed in its outer surface and may extend internally into the device compartment to form relatively soft corner pads or cushions. When a shell is employed additional level of protection to the mobile device may be provided. The shell may have transparent side walls that allow visibility to the shock absorber elements so that the user can perceive the protective construction of the case. A screen protector lid that retentively snaps into and out of the case or sleeve so as to provide additional protection to the mobile device is also disclosed. The shell may be used with or without the screen protector lid.

9 Claims, 30 Drawing Sheets

(58) Field of Classification Search
CPC .. A45C 2200/10; B65D 85/38; H04B 1/3888; G06F 1/1616; H04M 1/0214; H04M 1/0216; H04M 1/0245; H04M 1/02; H04M 1/14; H04M 1/0283; H04M 1/03; H04M 1/06; H04M 1/17; H04M 1/18; H04M 1/12; H04M 1/11; H04M 1/185; H04M 1/04; H04M 2250/16; E05D 11/00; G07F 9/04; H04R 1/12; H60R 11/0241; H60R 2011/0071; H60R 2011/0075; H60R 2011/0078; H60R 2011/008; H05K 9/0043; H05K 9/0041; H05K 9/0003; H05K 9/0018; H05K 9/003; H05K 9/0088; H05K 9/0037
USPC ..... 206/320
See application file for complete search history.

(56) References Cited

U.S. PATENT DOCUMENTS

| | | | | |
|---|---|---|---|---|
| 9,392,854 | B2 | 7/2016 | Fathollahi et al. | |
| 9,622,556 | B2 | 4/2017 | Fathollahi et al. | |
| 2014/0262847 | A1* | 9/2014 | Yang ..... | A45C 11/00 206/37 |
| 2015/0194995 | A1* | 7/2015 | Fathollahi ..... | H04B 1/3888 455/575.8 |

* cited by examiner

MOBILE DEVICE CASES AND CASE SYSTEM WITH EMBEDDED SIDEWALL SHOCK ABSORBER

INCORPORATION BY REFERENCE TO RELATED APPLICATIONS

This application claims benefit under 35 U.S.C. § 119(e) from U.S. Provisional Application No. 62/192,030, filed on Jul. 13, 2015, which is hereby incorporated by reference in its entirety.

BACKGROUND OF THE INVENTION

Field of the Invention

This patent document relates to user removable protective enclosures or cases for mobile devices and more particularly to such cases and case systems that have one or more discrete shock absorber elements integrally molded and embedded into the external surface of a sidewall.

Description of the Related Art

Mobile devices, such as smart phones, tablets, MP3 players, gaming devices, laptops and the like are known to sustain damage from impact and from contamination as a result of ingress of dust, dirt, water, or other fluid. The damage, for example, may result in a cracked screen, scratches on a finished surface, lost or damaged buttons or controls, cracked or bent external body components, and/or failed or malfunctioning user interfaces and electrical components. Protective cases have thus been provided to protect mobile devices from such and variant types of damage.

It is here recognized, however, that there is a continuing and an ever increasing desire for protective cases and case systems for mobile devices that can provide improved protection that can be readily perceived by the user and incorporated into case configurations or systems with varying levels of protection.

SUMMARY OF THE INVENTION

Disclosed are numerous aspects relating to unique and inventive user removable protective enclosures or cases and systems for mobile devices, such as smart phones, tablets, laptops, MP3 players, gaming devices and other computing/electronic devices.

In one aspect the cases have one or more discrete shock absorber elements integrally molded and embedded into the external surface of a sidewall of another component that houses the mobile device and may be made of a material that is harder than the material that forms the shock absorber. The shock absorber may include one or more channels that are formed on its outer surface. The channels provide space that allows the channel walls to flex with force and thereby facilitate absorption of the force. The construct may be in the form of a stand-alone case or a sleeve configured to be received within another component.

In another aspect, the material that forms the shock absorber element also forms internal corner pads that are capable of providing additional cushion at the corners of the mobile device.

In another aspect, the case or case system may include a separate shell component that is configured to reversibly receive a flexible sleeve, which is configured to house the mobile device and which includes a molded component that forms the shock absorber element. The shell component may be comprised of transparent sidewalls that provide visibility to the shock absorber element and may be formed of a material that is more rigid than the materials that form the sleeve component.

In another aspect, the case or case system may include a screen protector that reversibly snaps or clips into and out of the case or sleeve to cover the front face or screen of the mobile device.

Numerous configuration and construction aspects of the various components and their manufacture are also described.

Each of the foregoing and various aspects, together with those set forth in the claims and disclosed herein, including the written specification and the drawings, may be combined to form claims for a device, apparatus, system, method of manufacture, and/or use without limitation.

BRIEF DESCRIPTION OF THE DRAWINGS

These and other features, aspects and advantages are described below with reference to the drawings, which are intended to illustrate but not to limit the invention. In the drawings, like reference characters denote corresponding features consistently throughout similar embodiments.

Each drawing is generally to scale and hence relative dimensions of the various layers and components can be determined from the drawings.

DETAILED DESCRIPTION OF THE PREFERRED EMBODIMENT

Figure 34:
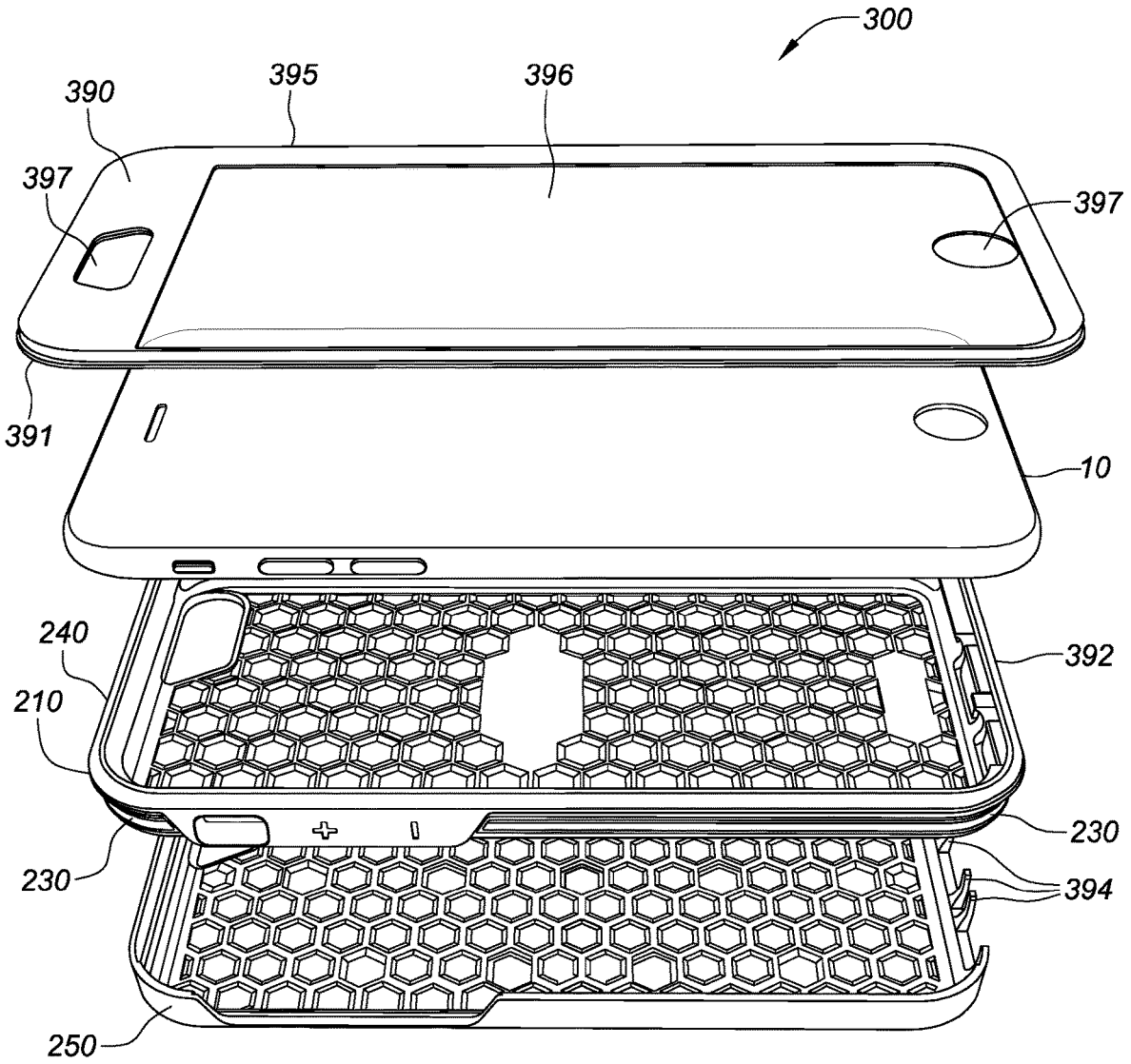
FIG. 34 is a drawing illustrating an exploded perspective top face view of the embodiment illustrated in FIG. 23 with the iPhone 6 disposed below the lid component.
Figure 35:
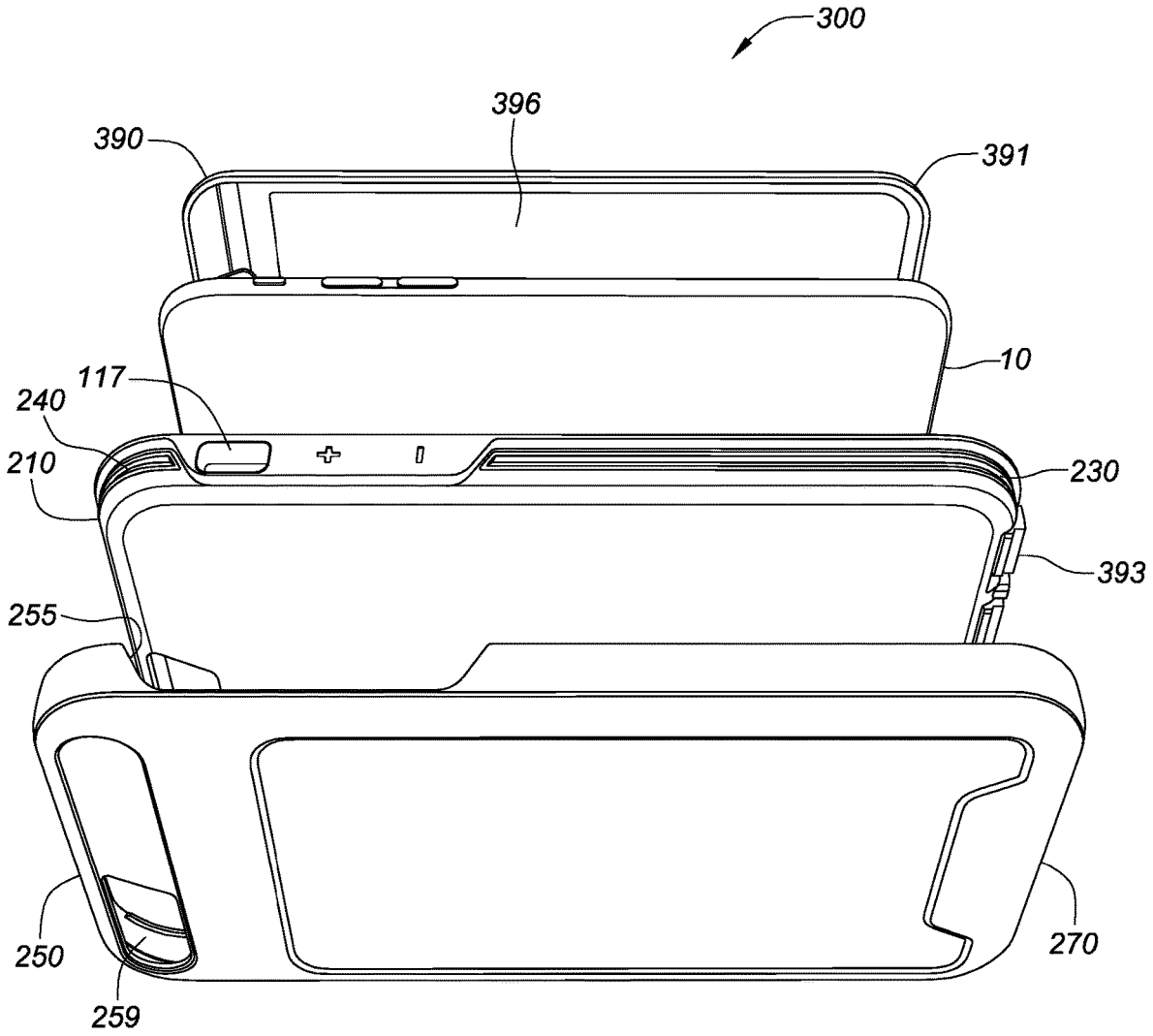
FIG. 35 is a drawing illustrating an exploded perspective bottom face view of the embodiment illustrated in FIG. 23 with the iPhone 6 disposed below the lid component.

As summarized above and illustrated in the drawings, disclosed herein are various aspects of new and inventive protective cases or a mobile devices. While the cases herein illustrated are configured specifically for an apple iPhone 6 smart phone, the teachings herein are not so limited and are applicable to protective cases for all types of smart phones and other mobile devices such as computing tablets, MP3 players, gaming devices, electronic controllers, laptops and the like. As illustrated in FIGS. 34-35, such mobile devices 10 typically include sides (left 11, right 12, top 13, and bottom 14), a back face 15 and a front face 16. The side typically have one or more user interface ports and buttons (e.g., charging ports, power buttons, volume buttons and microphone and speakers grills). The back face typically includes one or more camera and/or flash lens and sometimes also includes speakers or microphones and sometimes also touchscreen interfaces. The front face typically includes one or more touchscreens, perhaps a home button, one or more microphones and/or speakers, a camera lens, and one or more proximity sensors. Many of those aspects of the protective cases disclosed herein are summarized above and/or illustrated in the drawings.

FIGS. 1-11 illustrate a first embodiment of a protective case 100 that is generally comprised of a first molded component 110 that defines a compartment that is dimensioned to receive and protect the mobile device 10 (illustrated in FIGS. 34-35) for which it is configured, a second molded component 130 in the form of a shock absorber co-molded within the side walls of the first molded component 110, and a relatively rigid back face panel 150 that is co-molded to the bottom perimeter of the first molded component 110.

The first molded component 110 is formed of a polymer that is relatively more rigid (or less flexible) than the material that forms the second molded component 130 but less rigid (or more flexible) than the materials that forms the back face panel 150. Hence the second molded component 130 is formed of a material that is the most flexible out of the three components. For example the first molded component 110 may be formed of thermoplastic polyurethane (TPU) having a Shore A hardness of 85, the second molded component 130 may for formed of a thermoplastic elastomer (TPE) having a Shore A hardness of 65, and the molded back face panel 150 may be formed of a polycarbonate material having a hardness that exceeds the other two materials (e.g., Rockwell hardness of M70). While specific construction materials have been identified herein, it should be understood that any suitable polymer, polyurethane or plastic, or thermoplastic elastomer having suitable properties to allow for the desired flexibility or elasticity, yet preferably also have sufficient durability or resistance to oil, grease and abrasion may be employed.

As illustrated in FIGS. 1-11, the first molded component 110 is configured to extend around the perimeter of the mobile device 10 and includes inner and outer surfaces 111, 112, respectively, which define walls having upper and lower end regions 115, 116 that are configured to extend from the front face 16 of the device 10 towards the back face 15 of the device 10 with the inner surfaces of the walls being dimensioned to reside adjacent and snugly against the sides of the mobile device 10. The inner and outer surfaces of the first molded component 110 defines side walls (left, right, top and bottom sidewalls 123*a*, 123*b*, 123*c*, and 123*d* of the case 100 that correspond with the left, right, top, and bottom sides 11, 12, 13, 14 respectively of the mobile device 10 and extend longitudinally from the corners 122*a*, 122*b*, 122*c*, 122*d* that are defined thereby.

One or more user interface apertures 117*a*, 117*b*, 117*c*, 117*d* are provided in the defining walls of the component 110 to correspond with various user interfaces including the silent switch 17*a*, the headset jack 17*b*, the charging/communication port 17*c*, and speakers/microphone grill 17*d* of the device 10. In addition multiple control buttons 118*a*, 118*b*, 118*c*, which in the illustrated embodiment protrusions 119 are provided on the inner 111 surface and are configured to correspond with various control buttons on the device including, for example, the + and − volume control buttons 18*a*, 18*b* and the power button 18*c*. The wall thickness between the outer and inner surfaces 112, 111 may be thinner near the buttons as compared to adjacent or other regions to allow for additional flexibility by the user.

The first molded component further includes a projecting edge or lip 113 that is configured to extend from the upper end region 115 over the front face 16 of the mobile device 10 so as to define a major aperture 114 through which the front face 16 and the touchscreen of the mobile device 10 may be visible to the user when the device 10 is in the case 100. The lip 113 is configured to retain the device 10 within the compartment defined by the first molded component 110, yet also be flexible enough to allow for insertion and removal of the device 10 into the case 100 through the major aperture 114. As depicted in the drawings, the lip 113 protrudes around the entire major aperture 114 a uniform distance as measured from the outer surface 112. It should be understood, however, that the lip 113 may protrude different distance less or more in one or more regions and may not extend around the entire perimeter of the major aperture 114, but only partially or in discrete regions (e.g., one, two, three, or all sides (or portions thereof) and/or one, two, three or all four of the corners).

The first molded component 110 also includes one or more channels 120 disposed within its outer surface 112 between of the upper and lower end regions 115, 116 that extend longitudinally along one or more of the walls 123*a*-123*d*. In the illustrated embodiments the channels 120 do not extend into the user interface aperture regions 117*a*-117*d* or the regions where the control buttons 118*a*-118*c* are provided. It is contemplated, however, that the channels may be configured to extend into one or more or all of those regions.

Retention apertures 121 (best seen in FIGS. 10-11) extending from the outer surface 112 to the inner surface 111 may also be provided in the first molded component 110. In the illustrated embodiment, the retention apertures 121 are positioned within the channels 120 at each of the four corners 123*a*-123*d*. It should be understood, however, that the apertures 121 may be positioned elsewhere along the channel 120, for example along one or more of the sides with or without the corner apertures. As will be described below, the retention apertures 121 may assist in securing and retaining the second molded component 130 to the first molded component 110 when they are co-molded to one another and thereby mitigate the second molded component 130 from peeling off the first molded component 110. It is also a means by which force may be transferred from the mobile device housed within the case.

Figure 36A:
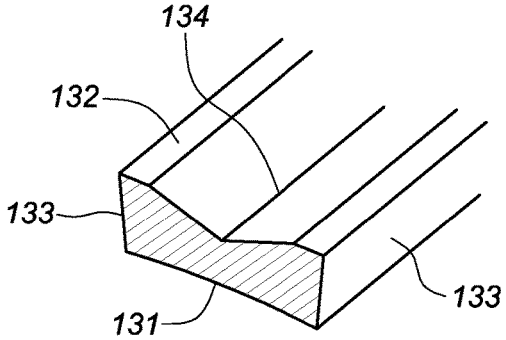
FIGS. 36A-36E are drawings illustrating isometric cross-section views of various configurations of the shock absorber component.
Figure 36B:
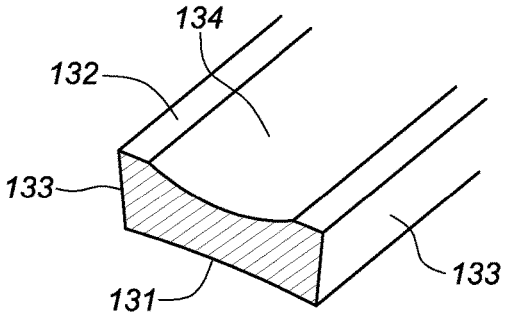
Figure 36C:
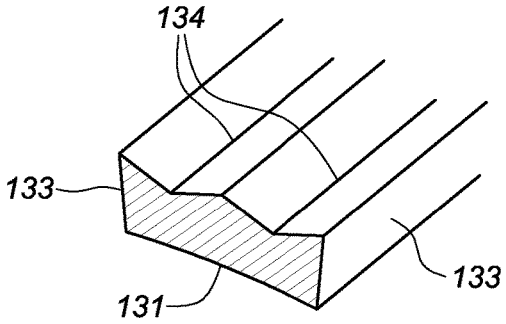
Figure 36D:
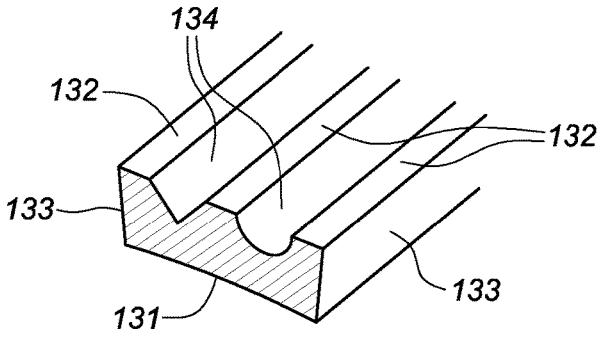
Figure 36E:
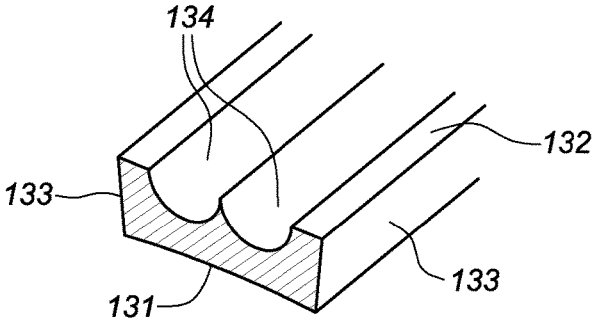

The second molded component 130 is co-molded into the channel 120 of the first molded component 110. It has an inner, outer, and side surfaces 131, 132, 133 respectively. The inner and side surfaces 131, 133 are in contact with the outer surfaces 112 of the channel 120 of the first molded component 110. The outer surface 132 includes one or more channels 134, which overlie and run longitudinally in parallel with the channel 120 defined in the first molded component 110. In the illustrated embodiments, the channel 134 is in the form of a "V" as generally depicted in FIG. 36*a*. It should be understood that the channel 134, or portions thereof, may have different cross-sectional configurations such as those depicted in FIGS. 36*b*-36*e*. Such configurations may include a semi-circle or semi-elliptical configuration such as that depicted in FIG. 36*b*, may have multiple channels 134 that are the same or different in cross-section, that have the same or different depths, or that are immediately adjacent to one another or are spaced apart such as those depicted in FIGS. 36*c*-*e*.

The inner surface 131 of the second molded component 130 is configured to conform with the corresponding channel 120 configuration of the first molded component 110 and may, as illustrated, be slightly concaved to conform with the outer surface 112 of the channel 120, which in turn corresponds to the curvature of the sides of the iPhone 6 phone for which it is designed to house. It should be understood, however, that the outer surface 112 of the channel 120 may be flat or convex or combination of different surfaces that may or may not correspond with the side walls of the mobile device that the case is configured to house.

When force is applied to the first molded component 110 (e.g., form impact of drop or the like), the force is transferred to the second molded component 130 which can absorb and dissipate the force through the inward and/or outward flexing of the walls that form channels 120 and 134. Improved protection of the mobile device may thereby be achieved. The second molded component 130 thereby is capable of serving as a mechanical shock absorber that is embedded within the sidewalls of the first molded component 110.

In order to provide improved co-molding adherence and protection, the second molded component 130 bleeds through the retention aperture 121 at the corners to form internal corner bumpers 135. Hence, the second molded component 130 sandwiches the first molded component 110 at those discrete regions in the corner. Because the internal corner bumpers 135 are formed of the relatively softer material that forms the second molded component 130, additional cushioning can be provided to the mobile device at the corners. This can be important in as much as the corners tend to be the regions that receive the greatest impact force when mobile devices are dropped or are subject to other impact.

As depicted in the illustrated embodiments, the second molded component 130 correspond in dimension with the channels 120 of the first molded component 110 and do not extend into the user interface aperture regions 117*a*-117*d* or the regions where the control buttons 118*a*-118*c* are provided. As previously noted, however, it is contemplated that the channels 120 may be configured to extend into one or more or all of those regions and hence it is contemplated that the second molded component 130 would also extend into those areas to correspond with the channel 120 regions of the first molded component 110. Also in the illustrated embodiments the second molded component 130 is generally flush or recessed at the channel 134 regions relative to the outer surface 112 of the first molded component 110. It should be understood, however, that the second molded component 130 may protrude outward in one or more regions beyond the plane of the outer surface 112 of the first molded component 110. In a preferred embodiment the second molded component may be forced of a differently colored materials than the first molded component so that the user or consumer can readily appreciate and perceive the design features and construction of the protective cases disclosed herein. Thus, it is contemplated that the first molded component may be formed of a dark material and the second molded component may be formed of a lighter material or vice versa. It is also contemplated that the second molded component may be formed of strikingly bright, vivid, glowing, or even fluorescent material as compared to the material that forms the first molded component.

In the first embodiment illustrated in FIGS. 1-11, the back face panel 150 is co-molded to the lower end region 116 at the bottom perimeter of the first molded component 110. It is formed of a more rigid polymer, such as polycarbonate. The back face panel 150 is configured to cover the back face 15 of the mobile device 10 and includes one or more additional apertures 151 that are configured to correspond with functional features of the mobile device such as the rear camera and flash that are commonly provided on the back faces of tablets and smart phones and other mobile devices. It should be understood that additional apertures may also be included for example apertures that correspond to other functional features such as microphones, speakers and other touchscreen or interactive screens elements that are positioned on the back face 15 of the device 10. Thus, while the back face panel 150 in the illustrated embodiments is configured to cover nearly all of the back face 15 of the mobile device 10, it should be understood that the back face panel 150 may only cover discrete or partial regions of the back face 15 of the device 10. Indeed, it should be understood that the back face panel 150 may only cover very small regions perhaps only around the perimeter of the back face 15 similar in amount to the protruding edge that forms the lip 113 and thus would leave nearly all of the back face 15 of the device 10 exposed akin to a protective bumper. The perimeter regions of the back face panel 150 that mate with the first molded component 110 may include tabs 152 having reduced thickness that facilitate adhesion to the co-molded lower end regions 116 of the first molded component 110.

The embodiment illustrated in FIGS. 1-11 may be manufactured via a multi-step injection molding that may include a double injection molding process. For example, a first steel mold is provided that has the shape of the back face panel 150, polycarbonate or other suitable material is injected into the mold and allowed to cool for a suitable period of time. The back face panel is removed and placed into another mold that is configured to form the first molded component. A first TPU is injected into a second mold to form the first molded component 110 co-molded over the tabs 152 of the back face panel 150. The resulting construct (with or without the second mold) is inserted into another or third mold that is configured to form the second molded component 130 and a second TPU material (less rigid and more flexible than the first TPU material) is injected into the third mold to form the second molded component 130 that forms the embedded shock absorber. The first molded component 110 may be formed for example of a TPU having a shore hardness of 85 and the second molded component 130 for example may be formed of a TPE having a shore hardness of 65. The back face panel 150 would be formed of a PC that has a greater hardness than either the TPU or TPE material used to form the other components in the construct. The construct may be printed in one or more regions to finish the case. For example, pad or tampography printing may be used to include a black camera ring around the camera/flash aperture 151.

Illustrated in FIGS. 12-22 is a second embodiment of a protective case 200 in accordance with the teachings herein. The second embodiment 200 generally includes the co-molded first and second molded components 210, 230 as previously described in connection with the first and second molded components of the first embodiment. However, rather than including a relatively rigid back face panel 150 that is co-molded to the first molded component 110, the first and second molded components 210, 230 together form a relatively soft or flexible sleeve 240. Rigidity in the case is provided by a separate housing or shell 250 that is dimensioned to reversibly receive the relatively soft sleeve component 240. When the sleeve 240 is secured over the mobile device 10 and then inserted into the shell 250 it is configured to fit firmly and snugly within the shell 250 so as to be retained therein by the force of the shell walls against the sleeve and hence the against the mobile device 10. The first and second molded components 210 and 230 have generally the same features as in the first protective case embodiment 100.

Namely, the first molded component is comprised of inner and outer surfaces 111, 112 that define the left, right, top and bottom side walls 123*a*-123*d* having upper and lower end regions 115, 116; edge protrusion or lip 113 that extends inwardly from the upper end region 115 and defines a major aperture 114; user interface apertures 117 to facilitate interaction with the user interfaces (ports and switches and speakers) on the device 10; control buttons 118*a*-118*c* that correspond with the control buttons 18*a*-18*c* on the device 10 and corresponding protrusions 119 thereof; longitudinally extending channels 120 that extend along the sidewalls; corner retention apertures 121 that facilitate adhesion and provide additional cushioning at the corner 122*a*-122*d*, all as previously described, with two exceptions.

First the regions of the sidewalls 123*a*-123*d* residing below the upper end region 115 are configured to be recessed relatively to the upper end region 115 (generally around outer surfaces 112 are that contains the channeled areas 120) so that the upper end regions 115 forms an external overhang or edge protrusion 124 that extends radially outwardly relative to the underlying side walls 123*a*-123*d*. The edge protrusion 124 is dimensioned and configured to reside on-top of the edges of the shell 250 when the sleeve 240 is inserted into the shell 250. The sidewall regions that are not recessed (e.g., where the user interfaces 117 and control buttons 118 reside) are configured to snugly fit within corresponding pen sided apertures 255 in the sidewalls of the shell 250 so as to further secure the sleeve 240 within the shell 250.

Second, the lower end region 116 of the first molded component 210 is not co-molded to the back face panel like it was in the first embodiment. Rather, the lower end region 116 is configured to extend into and form a continuous flexible back face panel 160, which includes a honeycomb pattern 161 on its inner surface 111 that is defined by relatively elevated honeycomb patterned walls 162 and recessed surfaces 163 residing within the honeycomb patterned walls 162. Thus, the back face panel 160 in the second illustrated embodiment 200 is a unitary extension of the first molded component 210 thereof as opposed to the discrete component 150 in the first illustrated embodiment 100 that is co-molded to the first molded component 110 thereof. While the illustrated embodiments only disclose the honeycomb pattern walls on the inner surface of the flexible back face panel 160 of the sleeve 240, it is contemplated that the honeycomb pattern may be formed on the back side or outer surface 112 of the back face panel 160 or may be formed on both the inner and outer surfaces 111, 112 of the back face panel 160.

In the illustrated embodiments, the back face panel 160 (like the back face panel 150) is configured to cover the back face 15 of the mobile device 10 and includes one or more additional apertures 164 that are configured to correspond with functional features of the mobile device such as the rear camera and flash that are commonly provided on the back faces of tablets and smart phones and other mobile devices. It should be understood that additional apertures may also be included for example apertures that correspond to other functional features such as microphones, speakers and other touchscreen or interactive screens elements that are positioned on the back face 15 of the device 10. Thus, while the flexible back face panel 160 in the illustrated embodiments is configured to cover nearly all of the back face 15 of the mobile device 10, it should be understood that the flexible back face panel 160 may only cover discrete or partial regions of the back face 15 of the device 10. Indeed, it should be understood that the flexible back face panel 160 may only cover very small regions perhaps only around the perimeter of the back face 15 similar in amount to the protruding edge that forms the lip 113 and thus would leave nearly all of the back face 15 of the device 10 exposed akin to a protective bumper. Corresponding apertures in the flexible back face panel 160 may be formed in the shell 250 to allow user accessibility to the corresponding features of the device 10.

Similarly, the second molded component 230 of the second protective case embodiment 200 includes the same features as the second molded component 130 of the first protective case embodiment 100. Namely, the second molded component 230 includes the inner and side surfaces 131, 133 that are in contact and co-molded to the walls of the channel 120 of the first molded component 210; an exterior or outer surface 133 that includes one or more channels 134 formed and extending therein; and corner bumpers 135 that extend into the mobile device compartment at the corners 122*a*-122*d* via apertures 121 in the first molded component to form relatively soft internal corner pads that can provide additional cushioning to the mobile device 10 as previously described.

The shell component 250, is configured to surround the sleeve 240 including under the flexible back face panel 160 and along the sidewalls 123*a*-123*d* as illustrated. The shell component 250 thereby is capable of providing additional rigidity to the assembled case and protection to the mobile device 10. The shell component 250 is generally comprised of a back face component 257 and left, right, top and bottom sidewalls 258*a*-258*d* respectively. The back face component 257 includes one or more apertures 259 that generally correspond to the apertures 164 on the back face panel 160 of the first molded component 210 to allow user accessibility to the features on the back face 15 of the device 10. In addition, the back face component 257 of the shell 240 includes a honeycomb pattern 261 on its inner surface 265 that corresponds in configuration with the honeycomb pattern 161 on the back face panel 160 of the first molded component 210 so that the walls 162 and recesses 163 overlie and track corresponding walls 262 and recesses 263 that form the honeycomb pattern 261 on the inner surface of the back face component 257 of the shell 250. The sidewalls 258 include the open sided apertures 255 that are configured to snugly receive the sidewall regions of the first molded component 210 that are not recessed (e.g., where the user interfaces 117 and control buttons 118 reside) so as to further secure the sleeve 240 within the shell 250. Regions of the shell 250 underlying or adjacent to the apertures 250 may be strengthen by making those regions thicker or by incorporating support members across the apertures or underneath the apertures.

In the illustrated embodiments, the shell component 250 is generally formed of two co-molded components 270 and 280. The first is a relatively rigid or hard panel component 270 formed of PC or the like that defines the internal side of the back face component 257 and the side walls 258*a*-258*d*. The second is a relatively softer and less rigid cover panel 280 formed of TPU or the like that covers or caps the outer surface 271 of the panel component 270. Interlocking honeycomb wall structures 282 extending from the inner surface 281 of the cover panel 280 extend through the corresponding recessed regions 263 adjacent walls 262 that form the honeycomb pattern 261 on the inner surface 265 of the shell 250. The relatively softer pliable material that forms the cover panel may deaden impact while the more rigid perimeter panel component protects the core.

The embodiment illustrated in FIGS. 12-22 may be manufactured via a multi-step injection molding that may include multiple double injection molding processes. With respect to the construction of the sleeve 240, for example, a first steel mold is provided that has the shape of the first molded component 210 including the back face panel 160. TPU or other suitable material is injected into the mold and allowed to cool for a suitable period of time. The first molded component 210 is then placed into another mold or tool that is configured to facilitate co-molding the second molded component 230 into the channel 120 and through the apertures 121 of the first molded component 210. A second TPU or a TPE material (less rigid and more flexible than the first TPU material) is injected into the second mold or tool to form the second molded component 230, which includes the embedded shock absorber and corner cushions or bumpers 135 which together forms the soft flexible sleeve component 240. The resulting sleeve is removed for inspection and/or finishing. The TPU that forms the first molded component 210 may have a shore hardness of 85 and the TPE that forms the second molded component may be relatively softer with a shore hardness of 65.

With respect the manufacture of the more rigid shell, another steel mold is provided that is generally shaped like the rigid panel component 270 including apertures and honeycomb pattern. PC or the like is injected into the mold and allow to cool for a suitable time to form the rigid panel component 270. The resulting rigid panel component is inserted into another mold that is configured to co-mold the cover panel 280 over the outer surface of the rigid panel component 270. A softer TPU or like material is then injected into the mold to form the cover panel 280 and allowed to cool for a suitable period. The resulting shell pre-form construct is removed for inspection and finishing. For example, pad or tampography printing may be used to include a black camera ring on the outer surface 266 around the camera/flash aperture 259. The cover panel 280 may be formed using the same TPU (same mechanical properties e.g., same shore hardness having the same or different color) as that used to form the first molded component 210. It is contemplated for example that the TPU material be opaque and not transparent. The PC material that forms the relatively more rigid panel component 270 including the sidewalls 258*a*-258*d* of the shell 250 may be formed of a more transparent or clear material so that the user can see or better perceive the embedded bumper of the second molded component 230 when the sleeve 240 is inserted into the shell 250. The relatively more rigid material surrounding the bumper component effectively acts as a brace such that when the bumper deforms under stress the bumper pushes on the surrounding more rigidly formed components.

In operation, the user inserts the mobile device 10 into the relatively soft and flexible sleeve 240 via the major aperture 114. Once inserted, the sleeve 240 (with the mobile device contained therein) is inserted into the shell 250 so that the protruding side wall regions in the sleeve are fitted to corresponding open-end apertures in the shell 250.

Illustrated in FIGS. 23-35 is a third embodiment of a protective case 300 in accordance with the teachings herein. The third embodiment 300 is identical to the second including the first and second molded components 210, 230 that form the sleeve 240 and the shell component 250, except it includes additional protection over the screen or front face of the device and at the ports. Specifically, the third embodiment includes a transparent lid or screen protector 390 having a perimeter profile 391 that clips or fits into a corresponding channel 392 that is provided on the outer surface of the edge protrusion or lip 113 of the first molded component 210. Additionally, the sleeve 240 and in particularly first molded component 210 is fitted with molded flaps or doors 393 that are hinged to (or swing from) the upper end region 115 of the first molded component 210 over user interfaces apertures 117 such as the apertures that correspond to the charging/data port and headphone jack apertures at the bottom side 123*c* of the case 300. Also as illustrated, the sidewalls of the shell may include supporting tabs 394 that are dimensioned to fit between the flaps 393 to provide additional support and to further seal the device compartment from debris.

Figure 1:
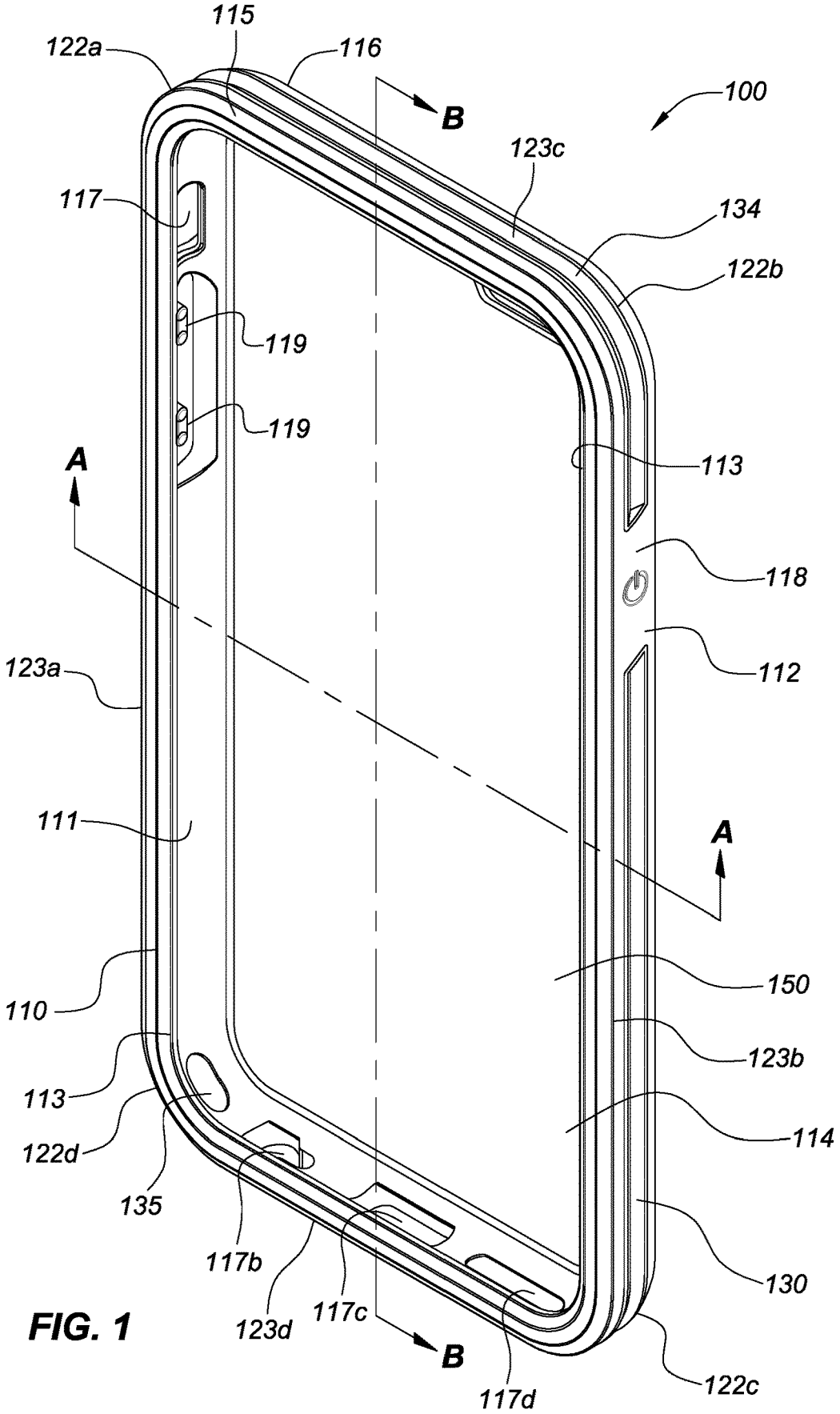
FIG. 1 is a drawing illustrating a front face perspective view of a first embodiment of a protective case for a mobile device in accordance with the teachings herein. The embodiment illustrated is particularly configured for an Apple iPhone 6 device.
Figure 2:
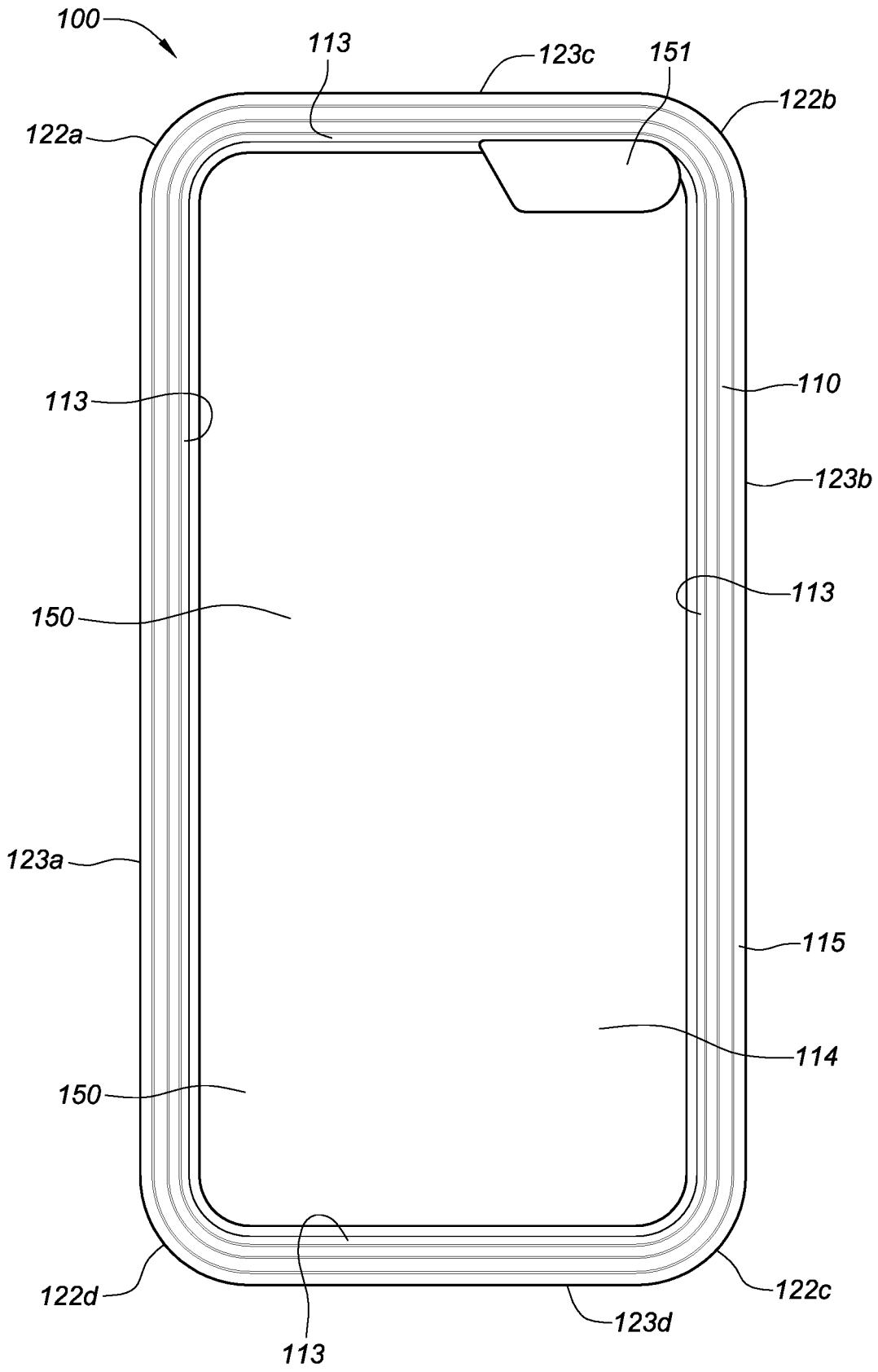
FIG. 2 is a drawing illustrating a front face view of the embodiment illustrated in FIG. 1.
Figure 3:
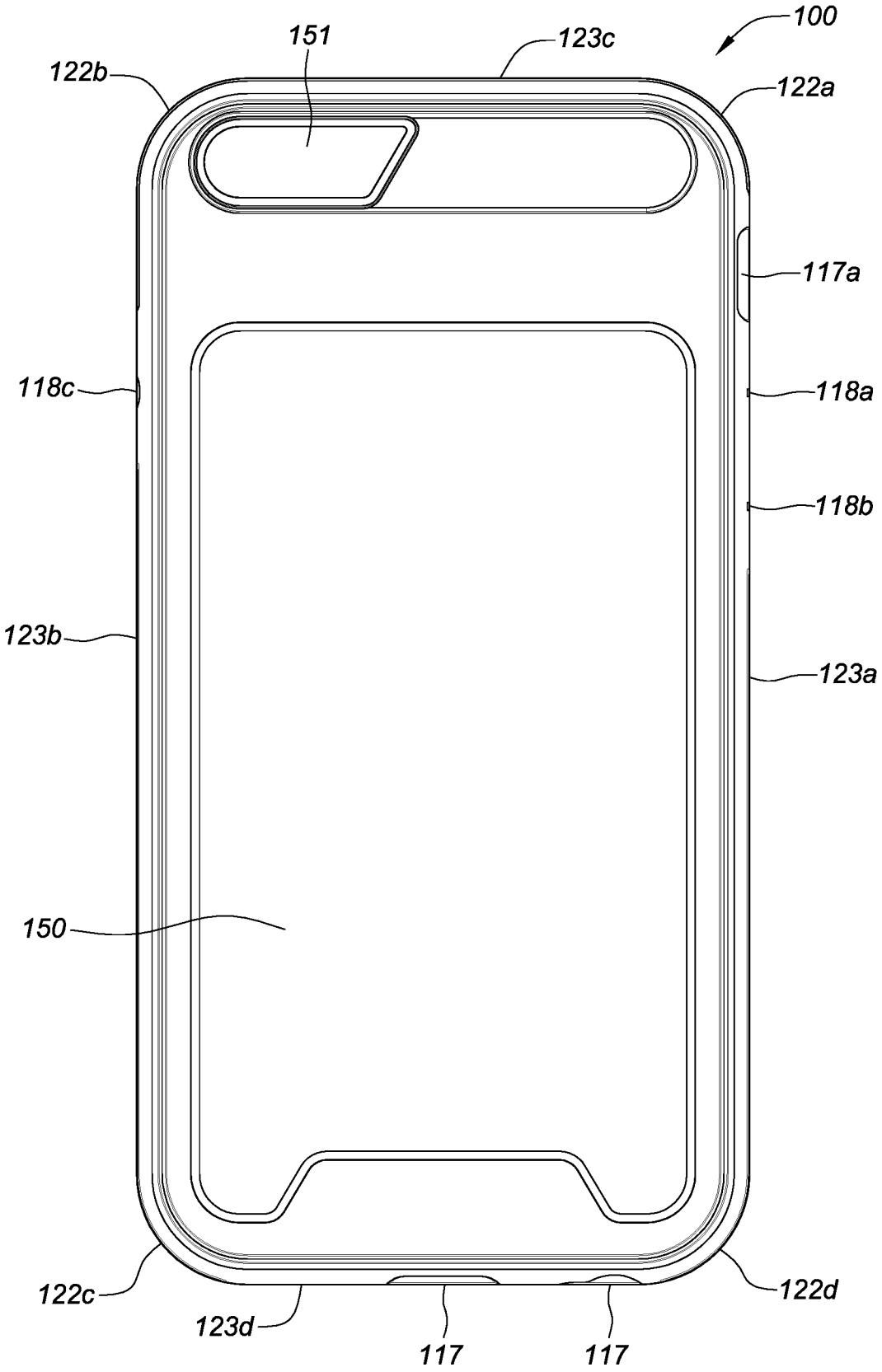
FIG. 3 is a drawing illustrating a back face view of the embodiment illustrated in FIG. 1.
Figure 4:
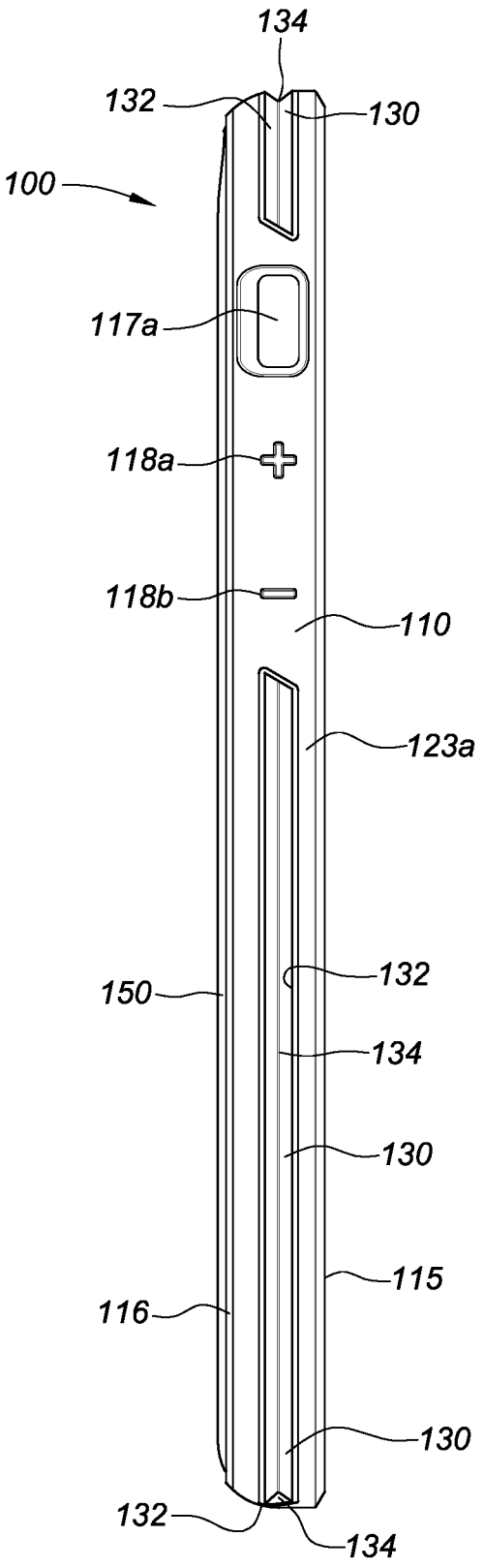
FIG. 4 is a drawing illustrating a left side view of the embodiment illustrated in FIG. 1.
Figure 5:
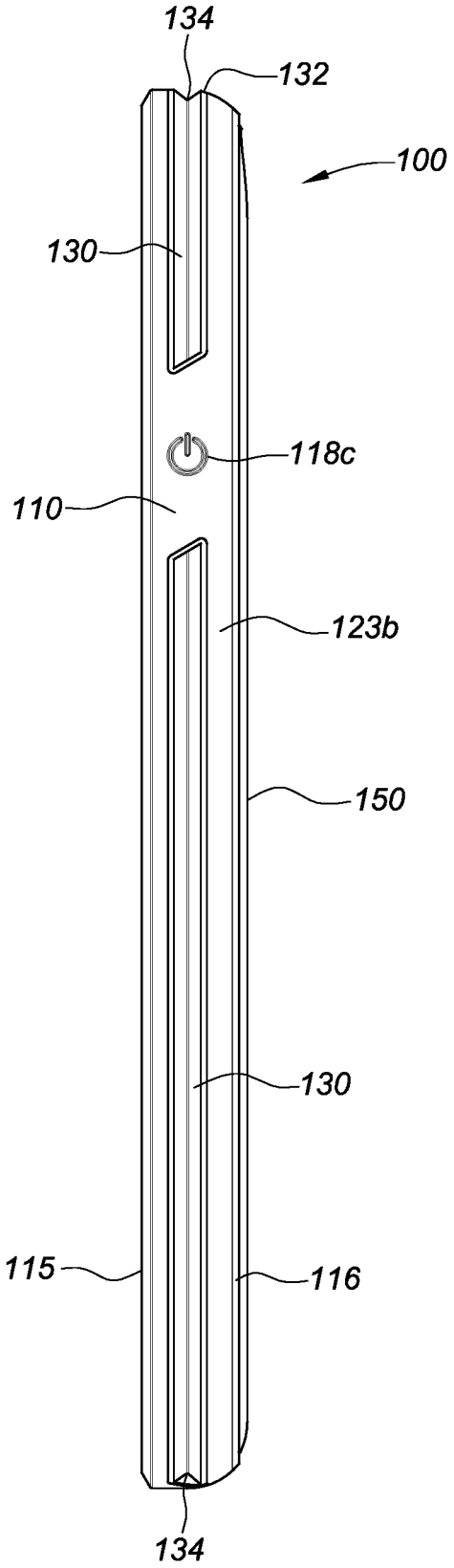
FIG. 5 is a drawing illustrating a right side view of the embodiment illustrated in FIG. 1.
Figure 6:
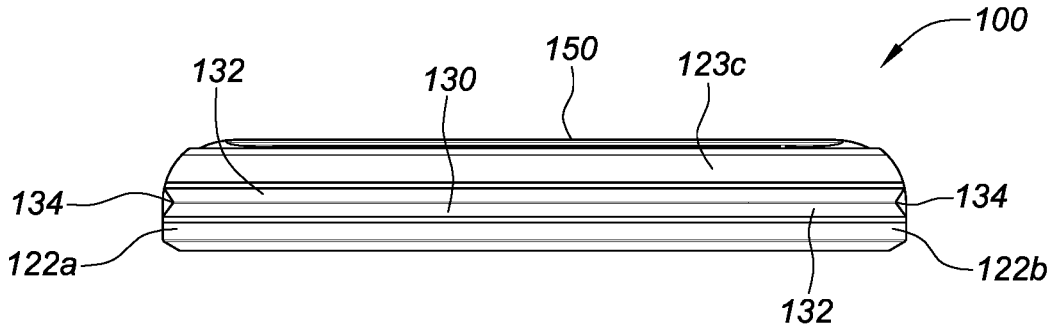
FIG. 6 is a drawing illustrating a top side view of the embodiment illustrated in FIG. 1.
Figure 7:
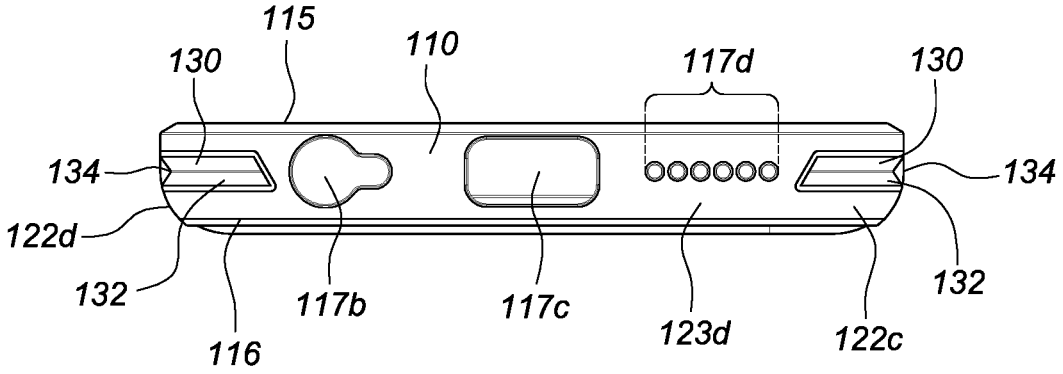
FIG. 7 is a drawing illustrating a bottom side view of the embodiment illustrated in FIG. 1.
Figure 8:
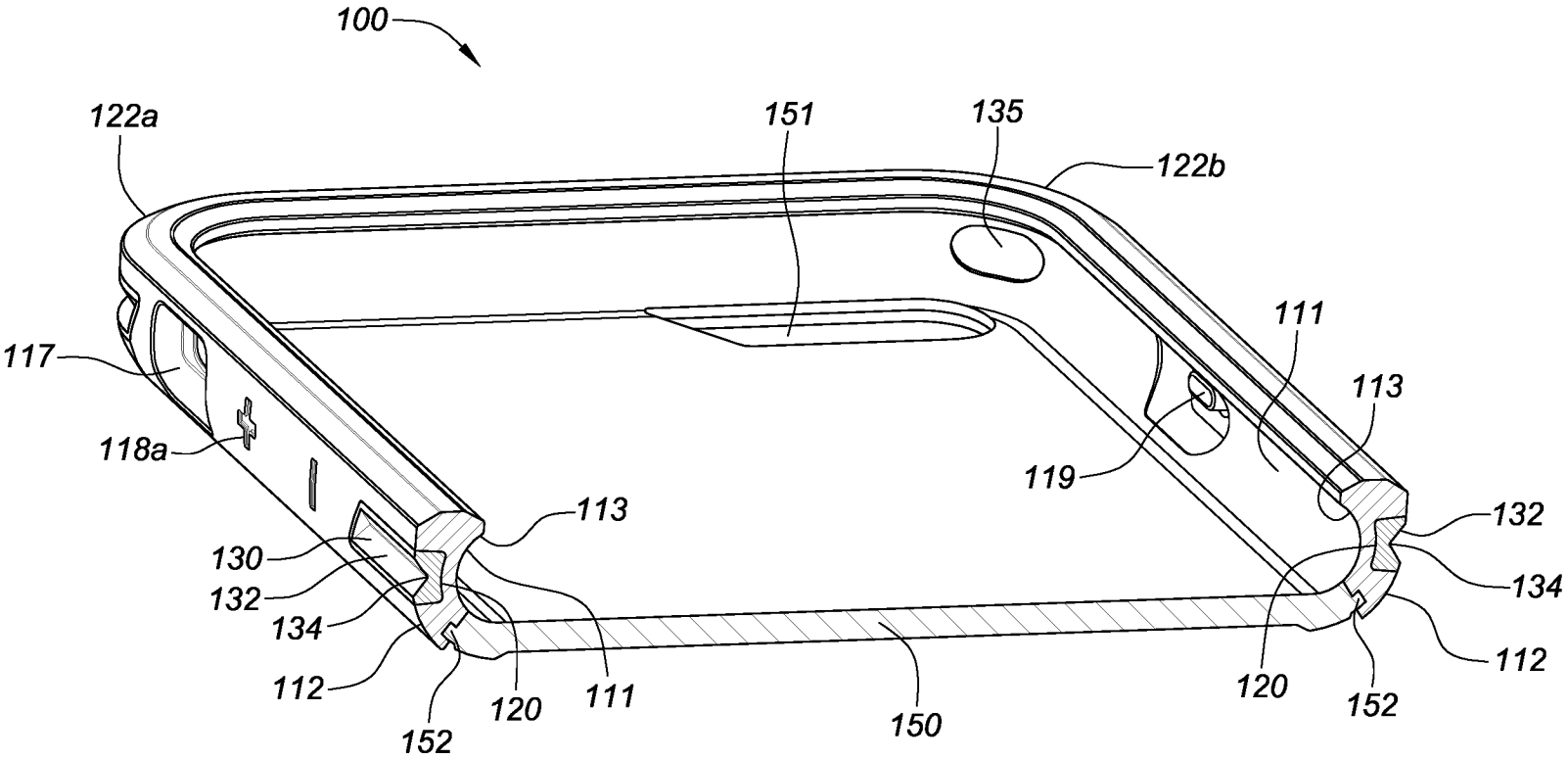
FIG. 8 is a drawing illustrating a cross-sectional perspective view taken along line A-A of the embodiment illustrated in FIG. 1.
Figure 9:
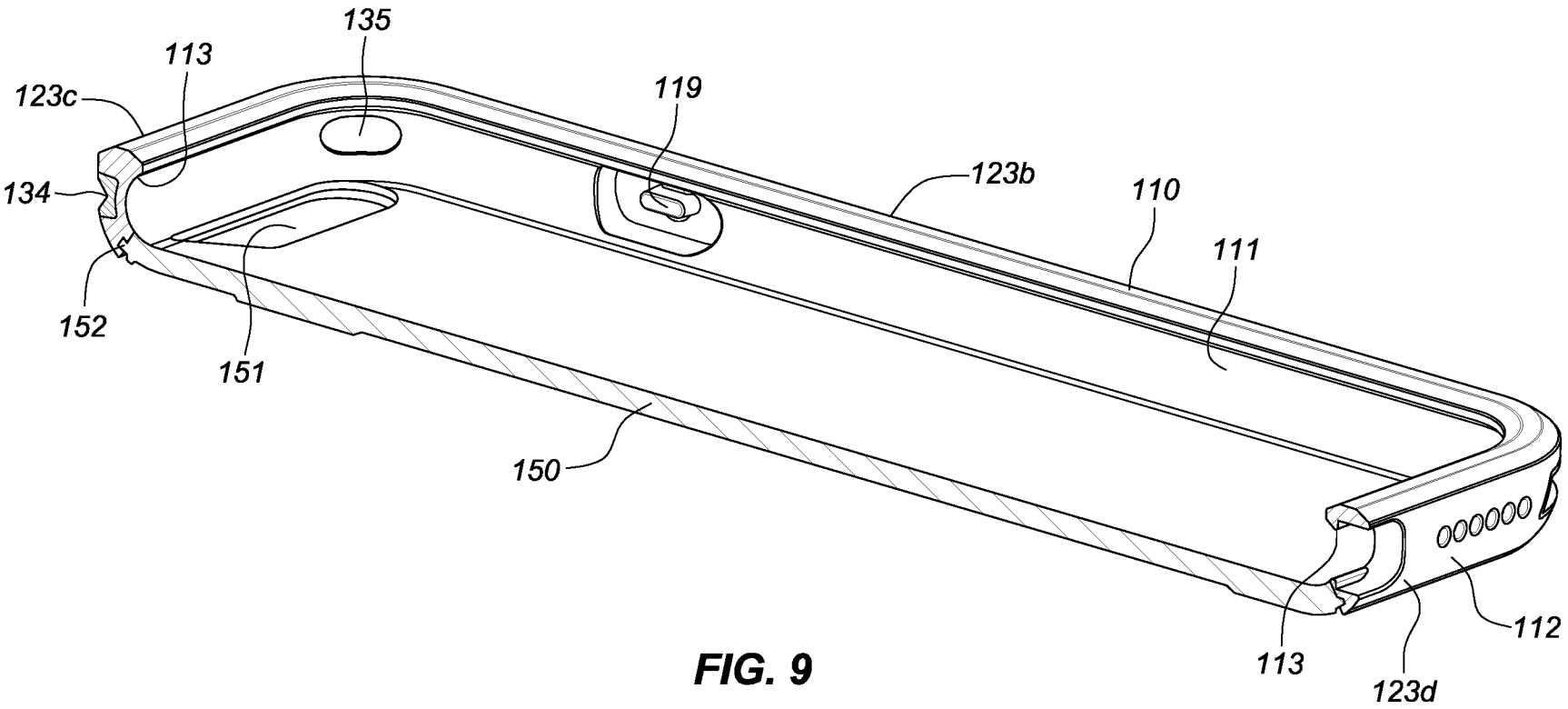
FIG. 9 is a drawing illustrating a cross-sectional perspective view taken along line B-B of the embodiment illustrated in FIG. 1.
Figure 10:
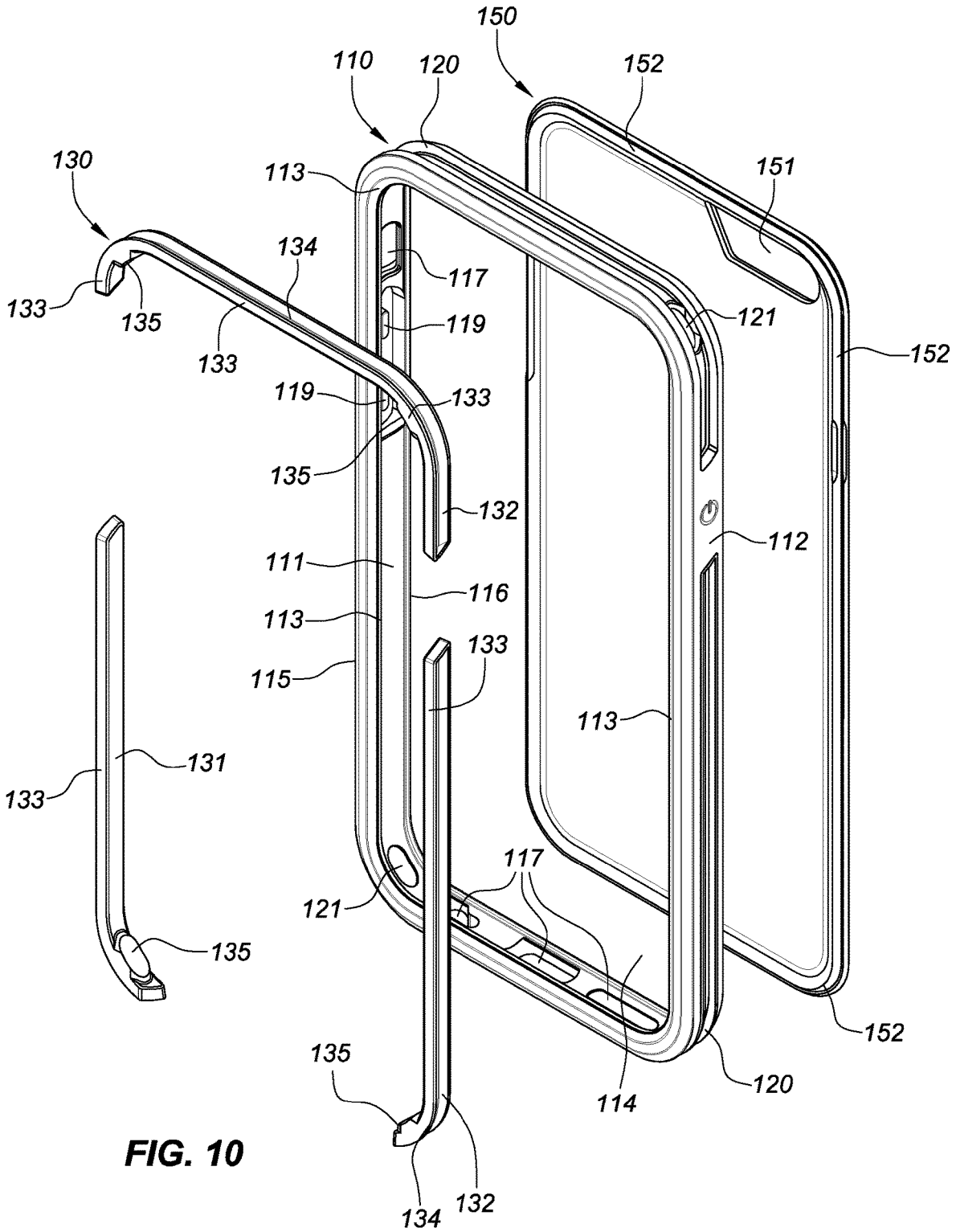
FIG. 10 is a drawing illustrating an exploded perspective view of the components that comprise the embodiment illustrated in FIG. 1.
Figure 11:
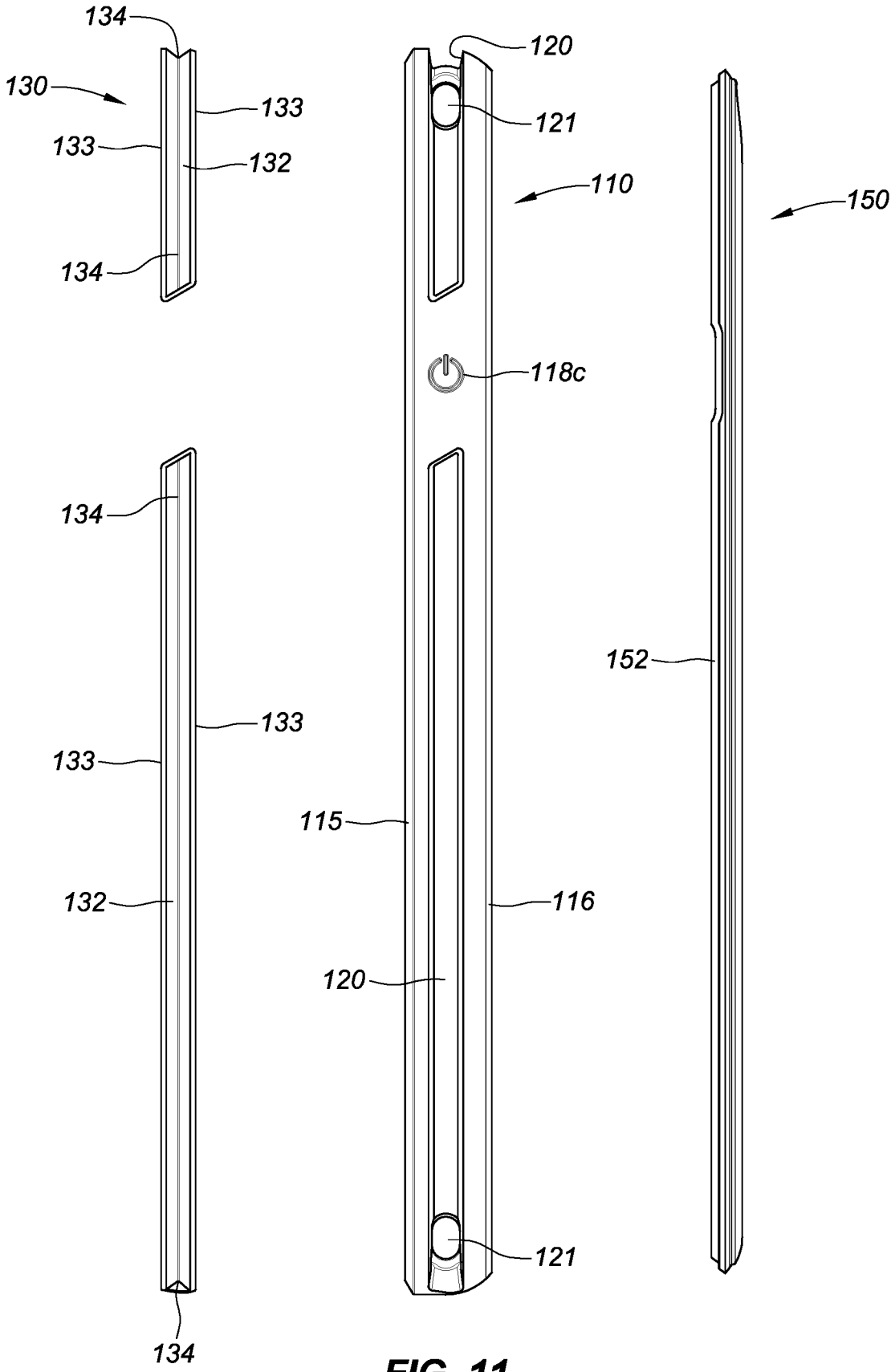
FIG. 11 is a drawing illustrating an exploded right side view of the components that comprise the embodiment illustrated in FIG. 1.
Figure 12:
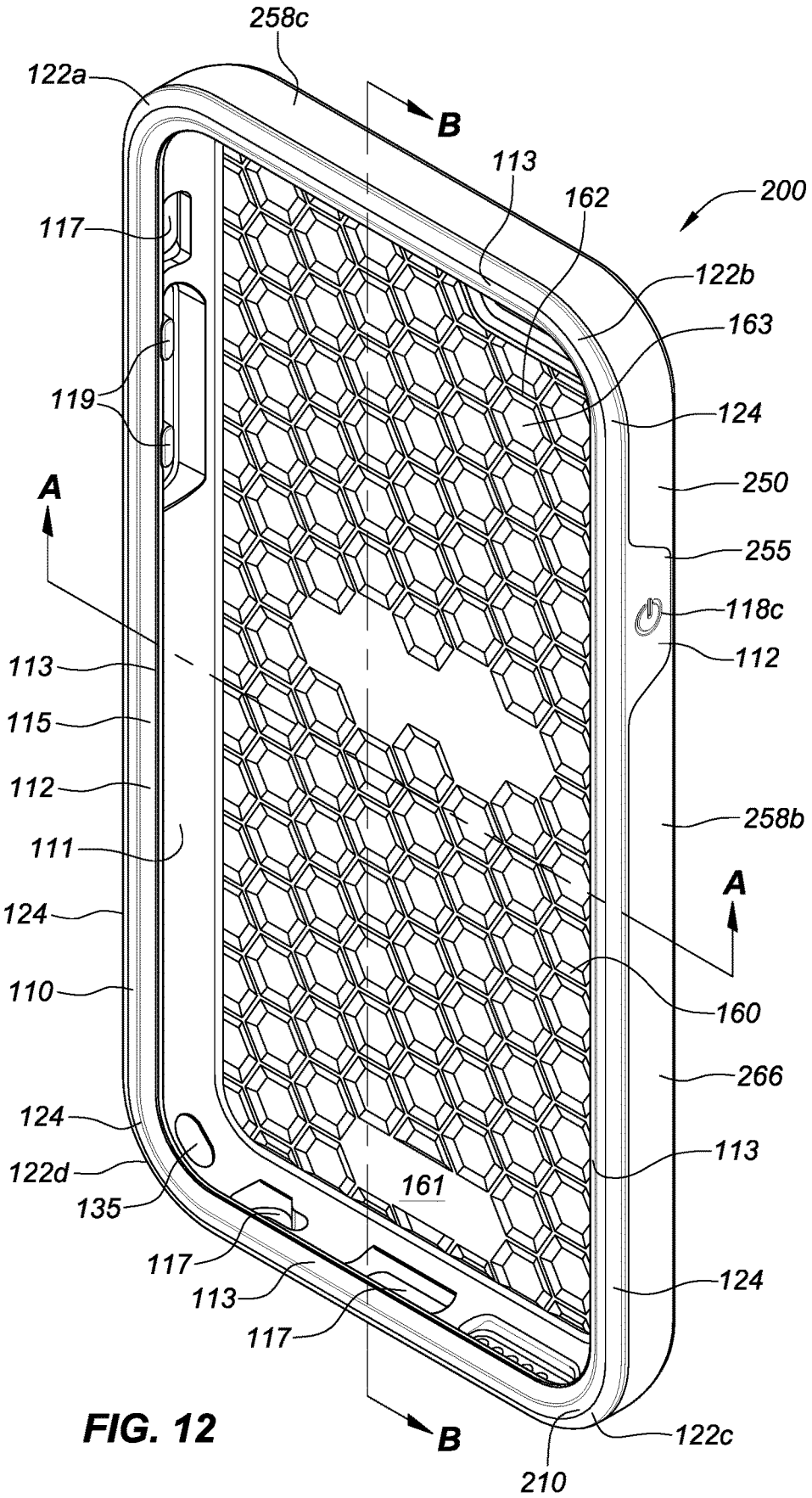
FIG. 12 is a drawing illustrating a front face perspective view of a second embodiment of a protective case for a mobile device in accordance with the teachings herein. Like the first embodiment, the embodiment illustrated is particularly configured for an Apple iPhone 6 device.
Figure 13:
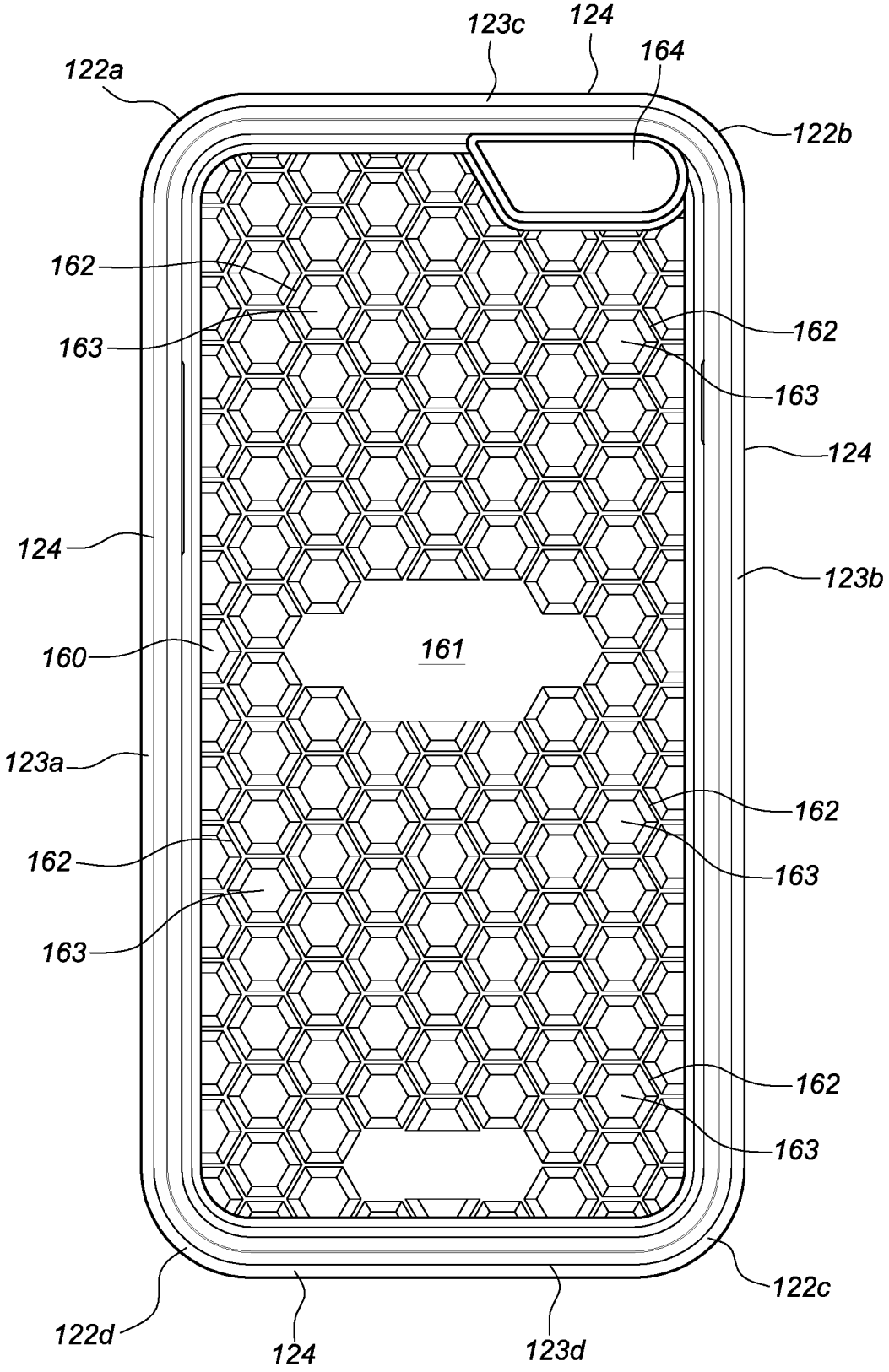
FIG. 13 is a drawing illustrating a front face view of the embodiment illustrated in FIG. 12.
Figure 14:
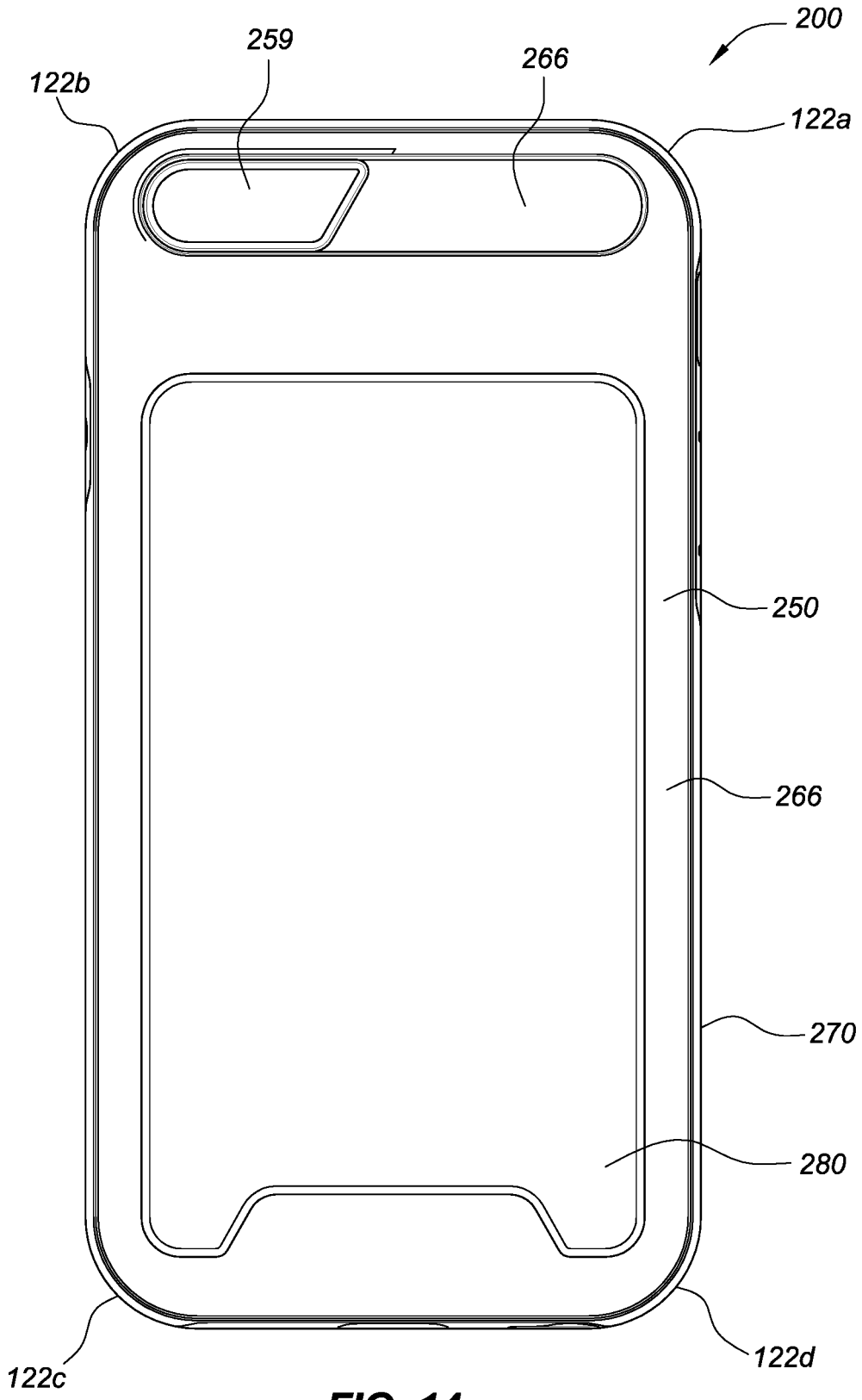
FIG. 14 is a drawing illustrating a back face view of the embodiment illustrated in FIG. 12.
Figure 15:
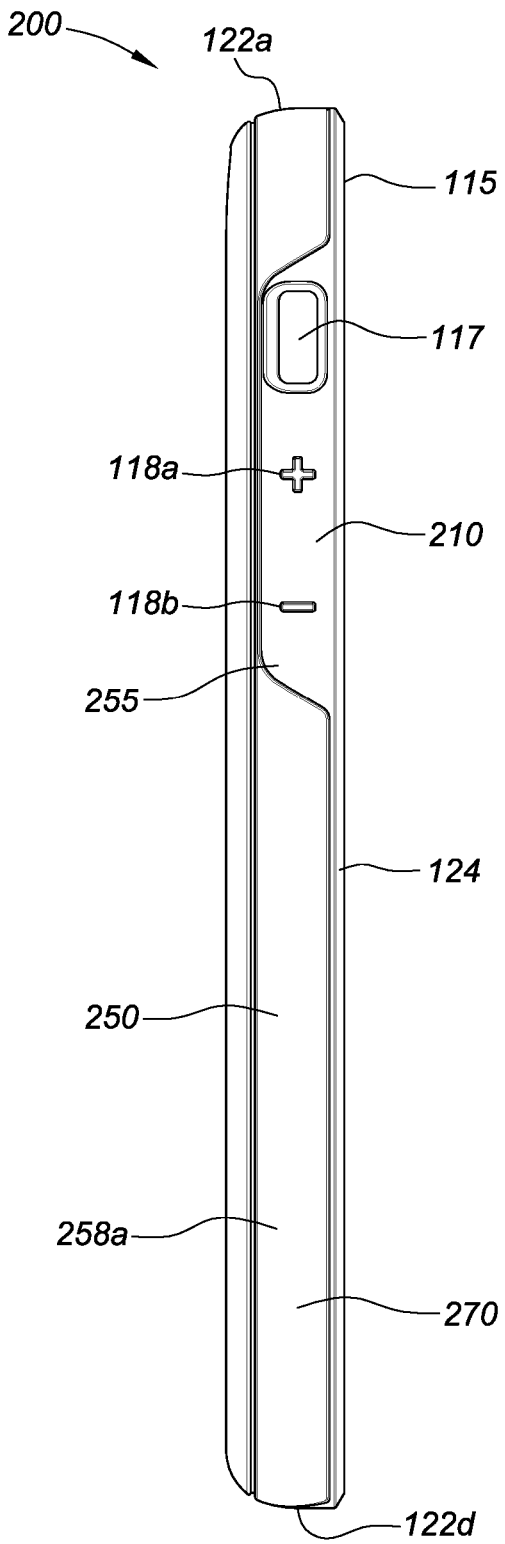
FIG. 15 is a drawing illustrating a left side view of the embodiment illustrated in FIG. 12.
Figure 16:
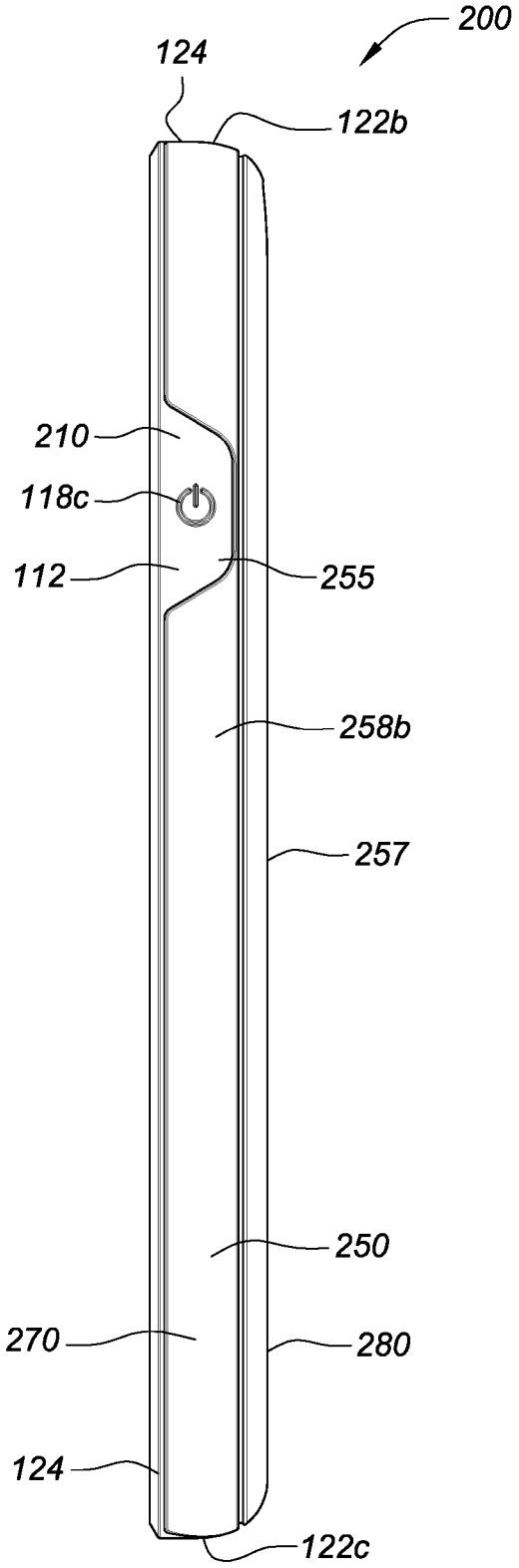
FIG. 16 is a drawing illustrating a right side view of the embodiment illustrated in FIG. 12.
Figure 17:
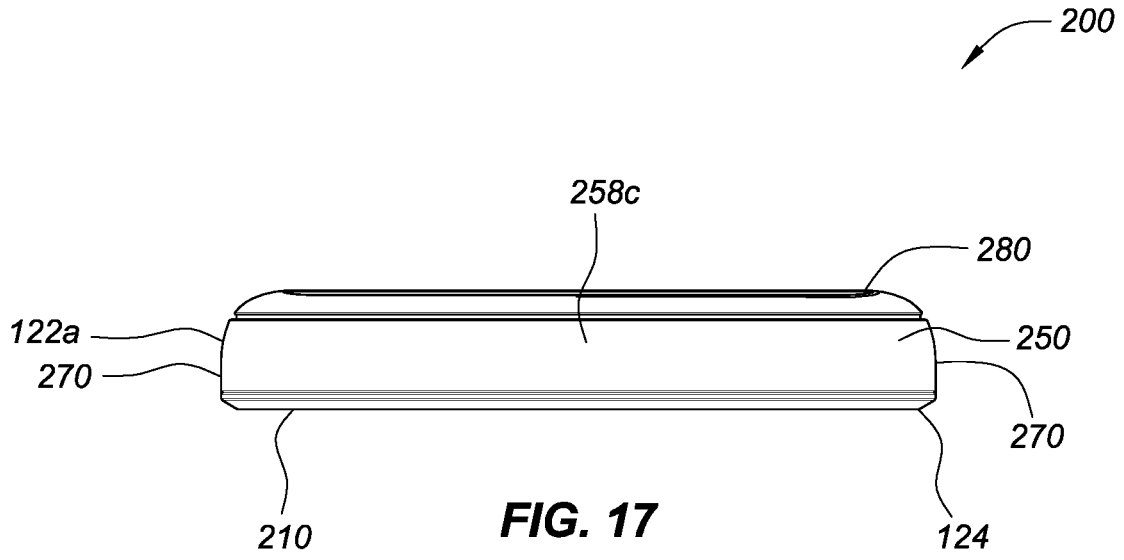
FIG. 17 is a drawing illustrating a top side view of the embodiment illustrated in FIG. 12.
Figure 18:
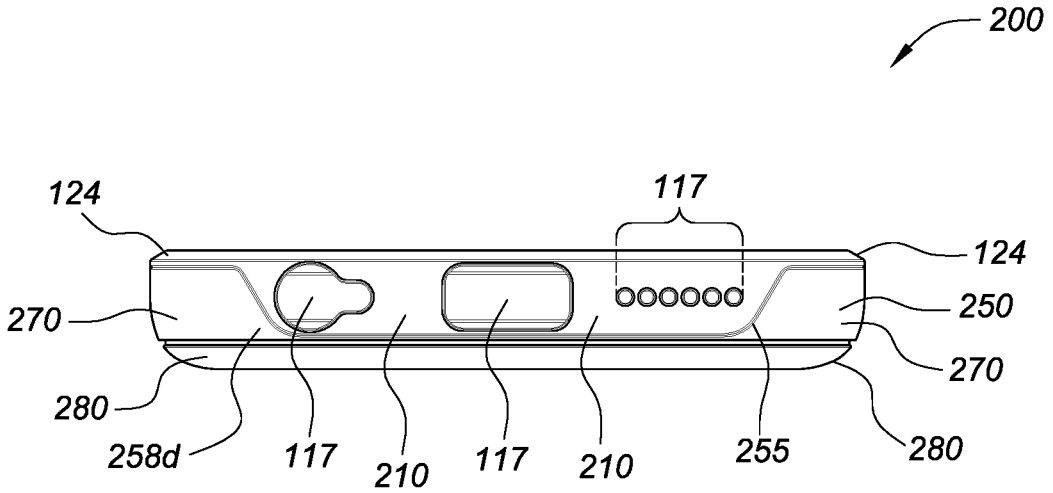
FIG. 18 is a drawing illustrating a bottom side view of the embodiment illustrated in FIG. 12.
Figure 19:
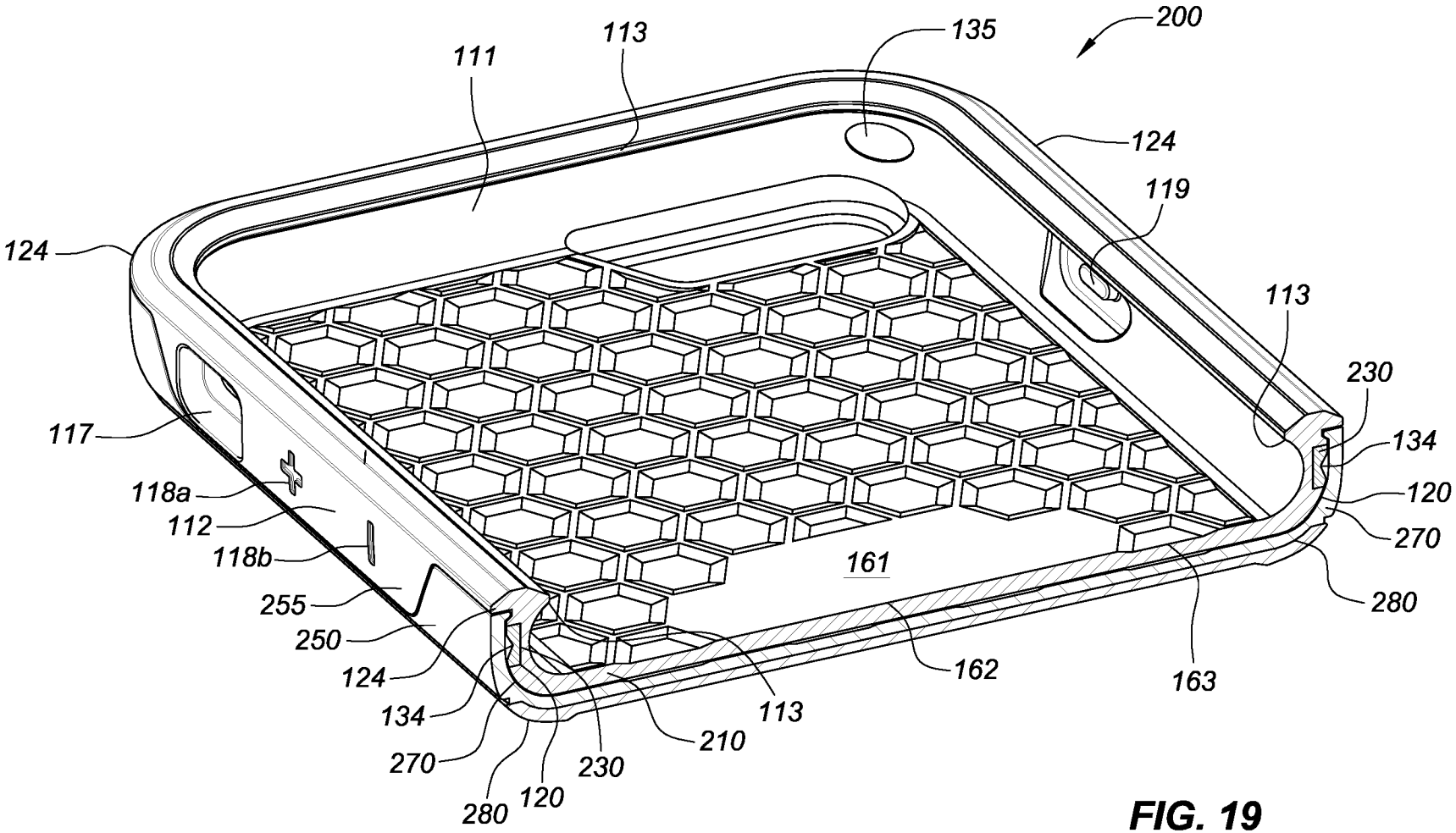
FIG. 19 is a drawing illustrating a cross-sectional perspective view taken along line A-A of the embodiment illustrated in FIG. 12.
Figure 20:
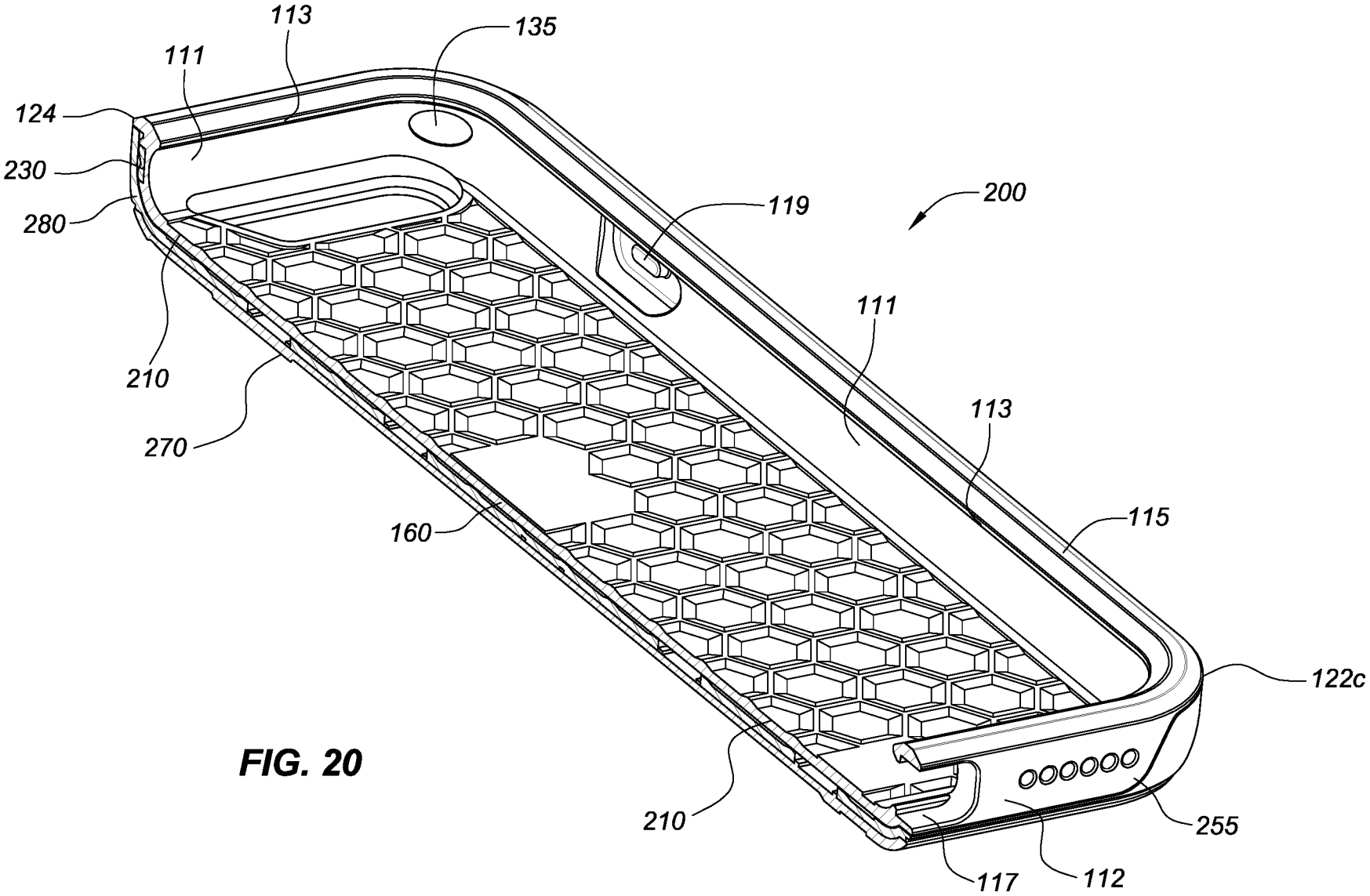
FIG. 20 is a drawing illustrating a cross-sectional perspective view taken along line B-B of the embodiment illustrated in FIG. 12.
Figure 21:
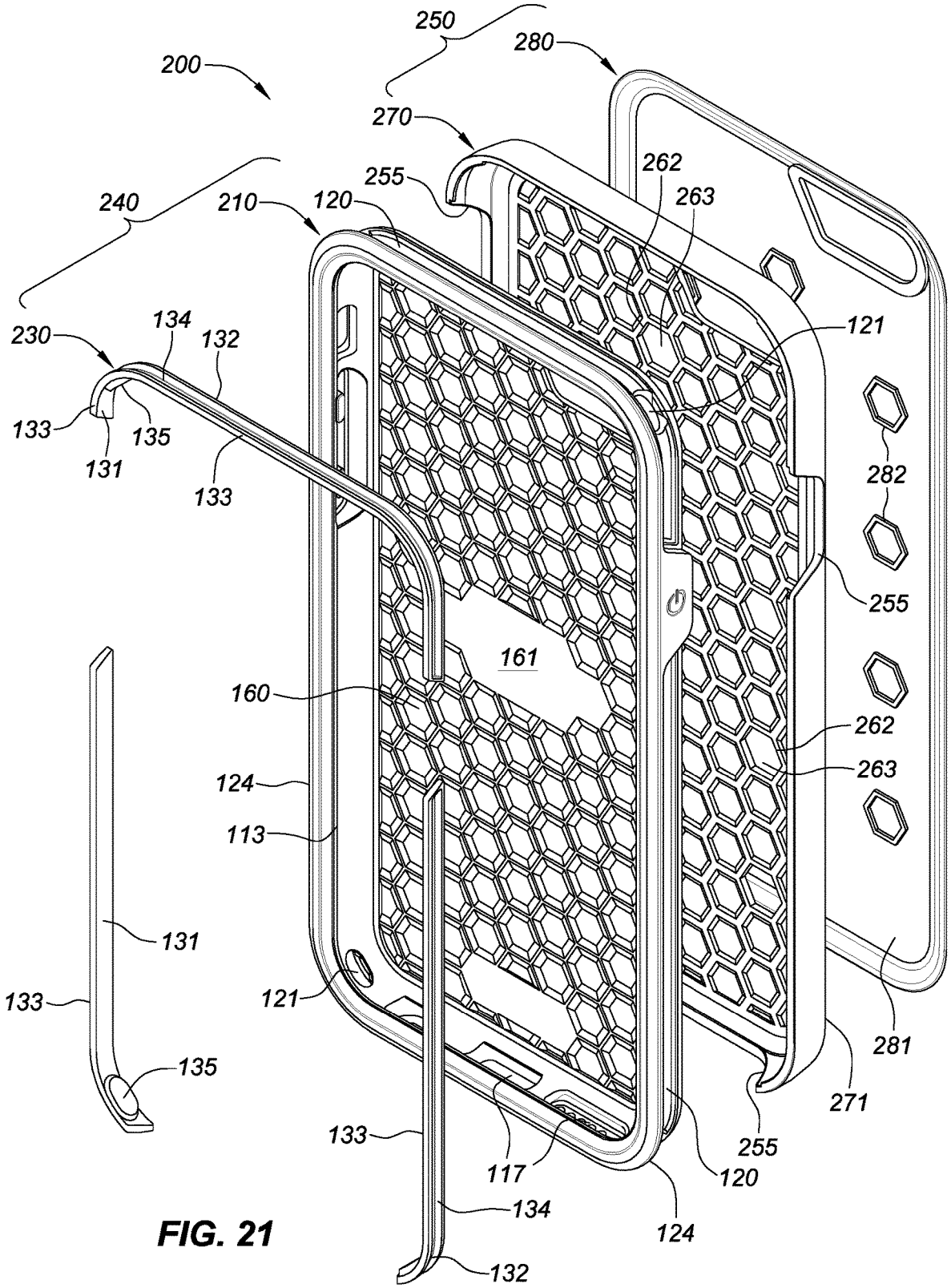
FIG. 21 is a drawing illustrating an exploded perspective view of the components that comprise the embodiment illustrated in FIG. 12.
Figure 22:
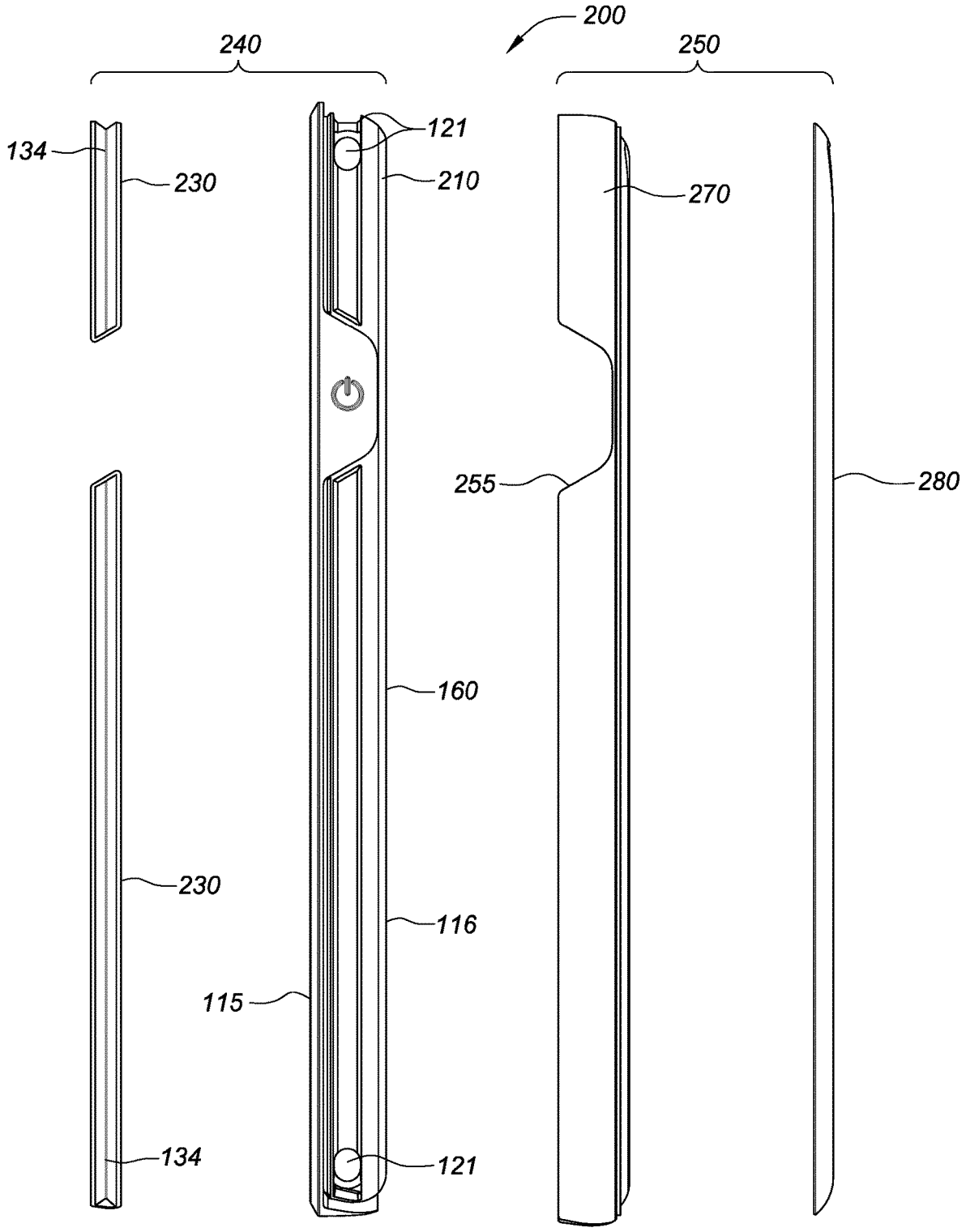
FIG. 22 is a drawing illustrating an exploded right side view of the components that comprise the embodiment illustrated in FIG. 12.
Figure 23:
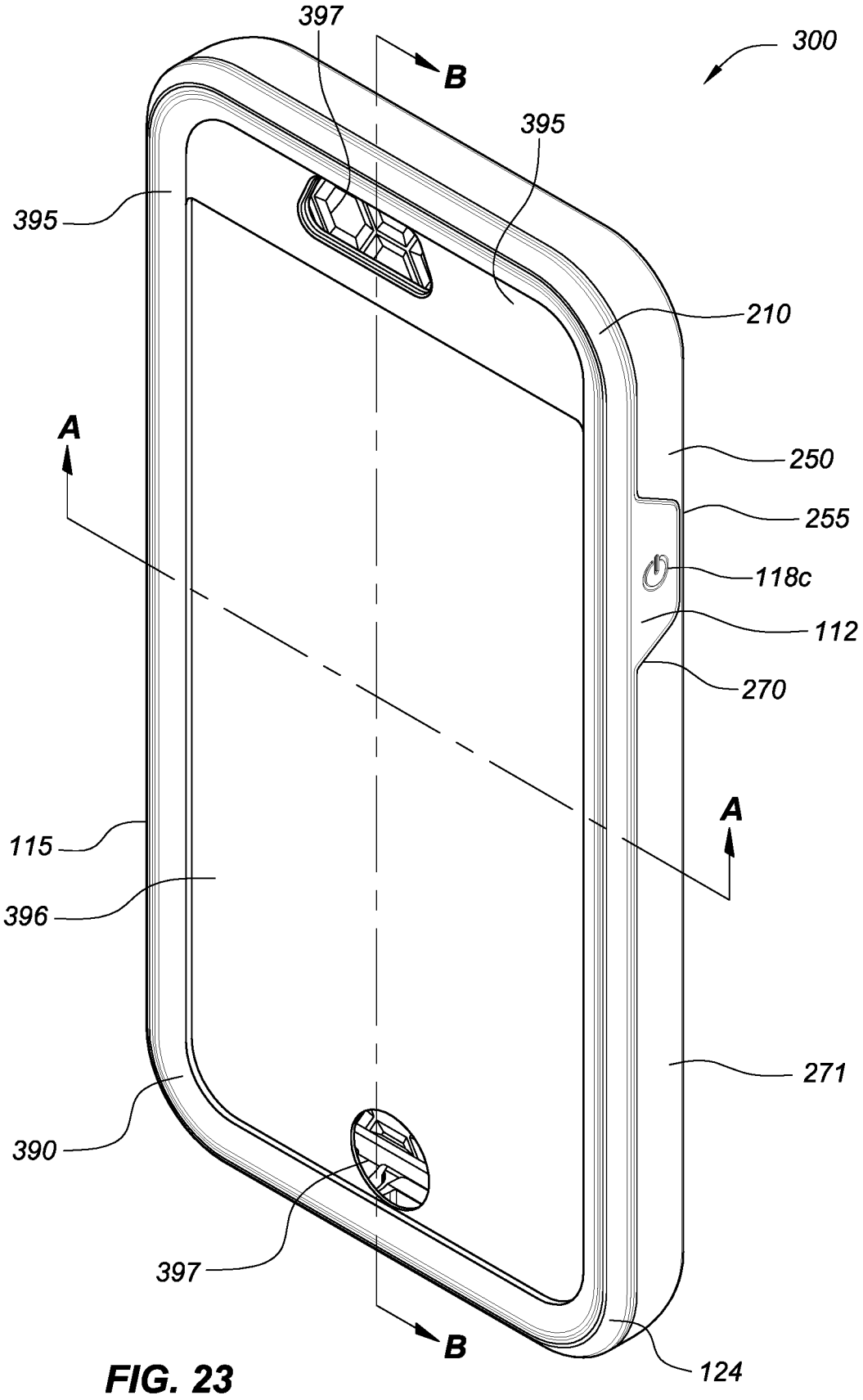
FIG. 23 is a drawing illustrating a front face perspective view of a third embodiment of a protective case for a mobile device in accordance with the teachings herein. Like the first embodiment, the embodiment illustrated is particularly configured for an Apple iPhone 6 device.
Figure 24:
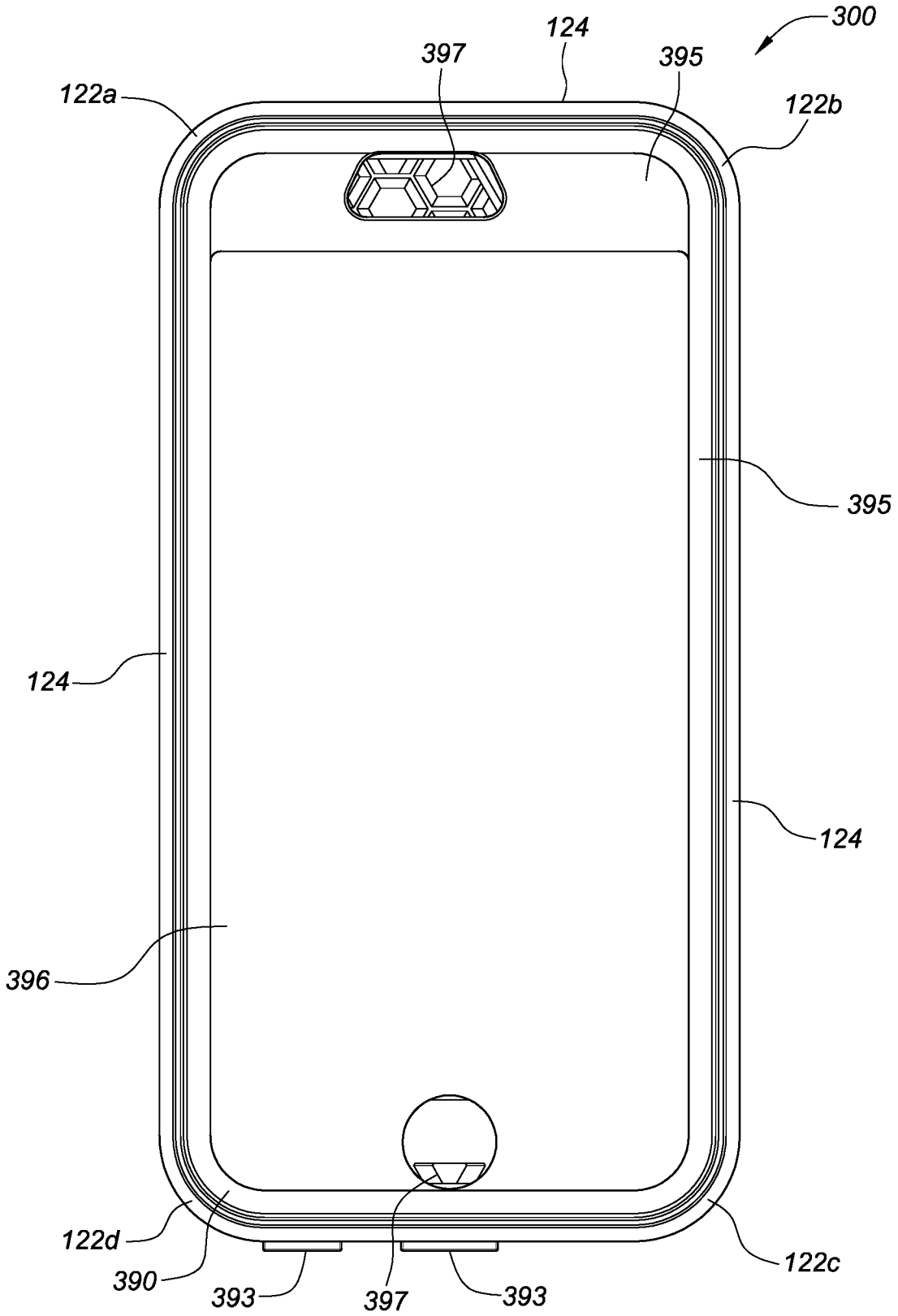
FIG. 24 is a drawing illustrating a front face view of the embodiment illustrated in FIG. 23.
Figure 25:
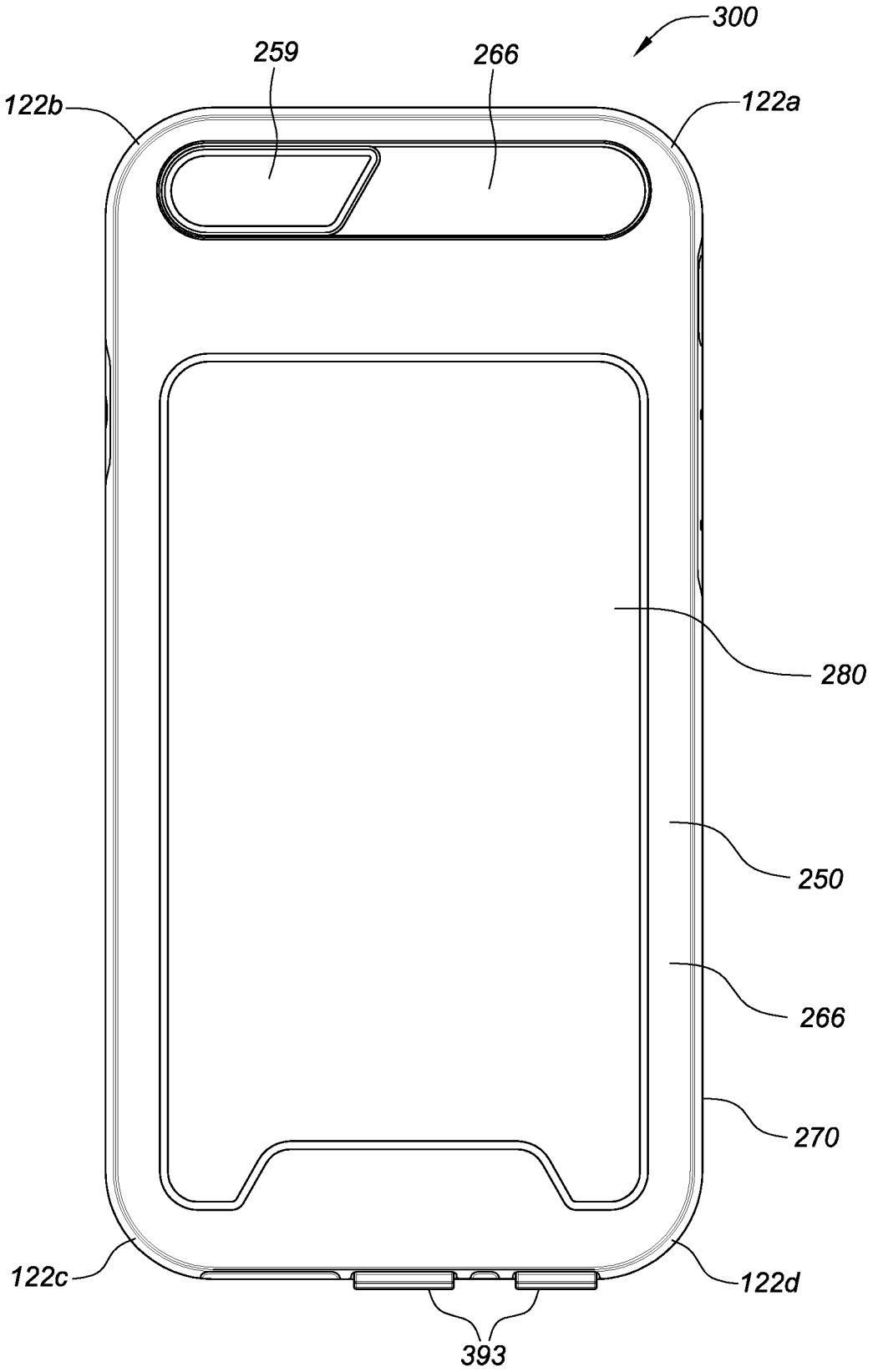
FIG. 25 is a drawing illustrating a back face view of the embodiment illustrated in FIG. 23.
Figure 26:
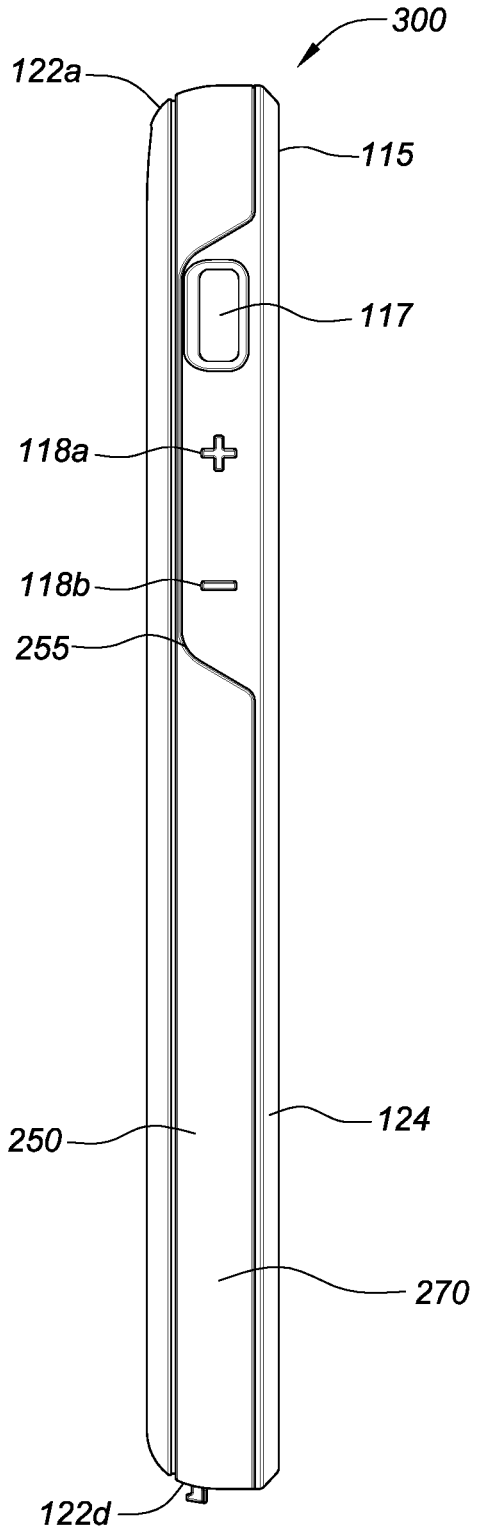
FIG. 26 is a drawing illustrating a left side view of the embodiment illustrated in FIG. 23.
Figure 27:
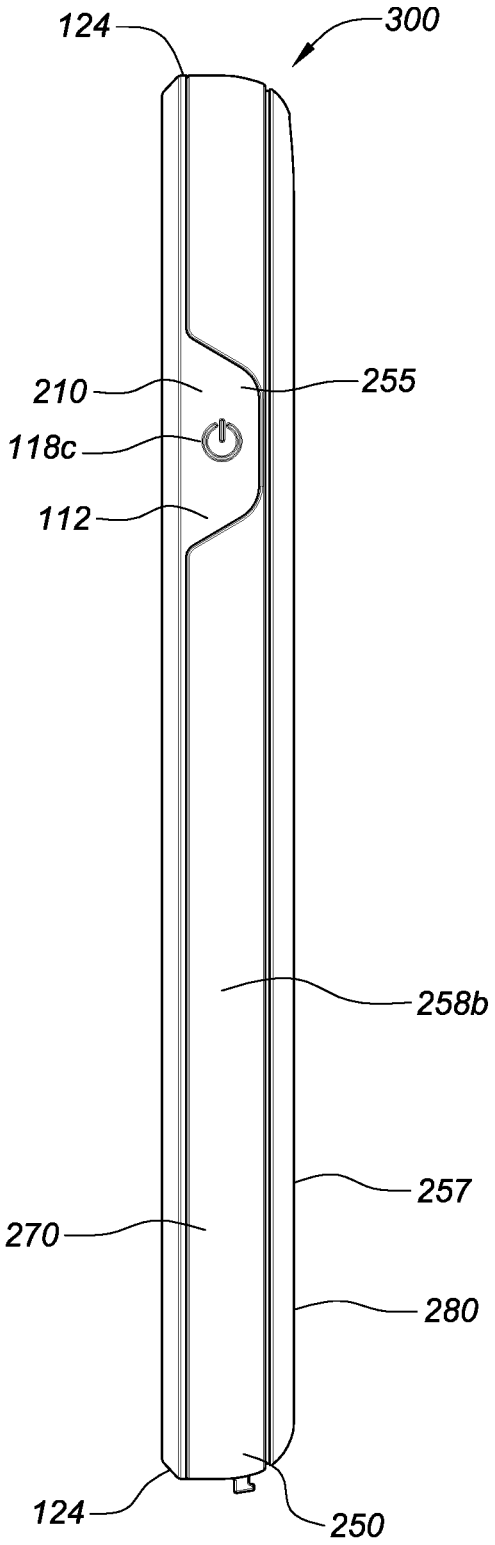
FIG. 27 is a drawing illustrating a right side view of the embodiment illustrated in FIG. 23.
Figure 28:
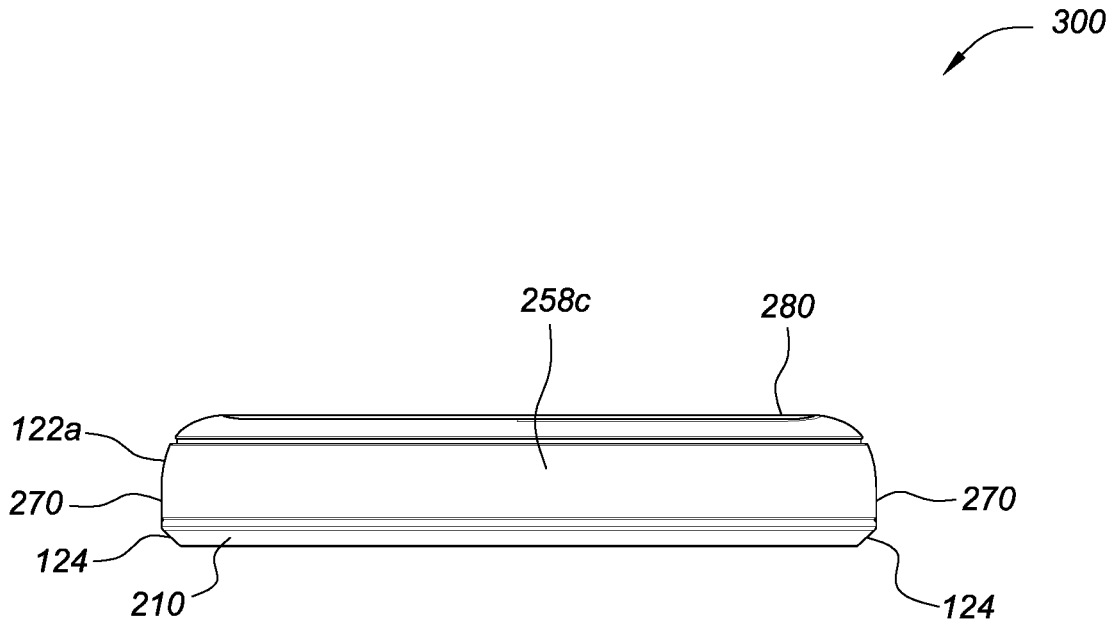
FIG. 28 is a drawing illustrating a top side view of the embodiment illustrated in FIG. 23.
Figure 29:
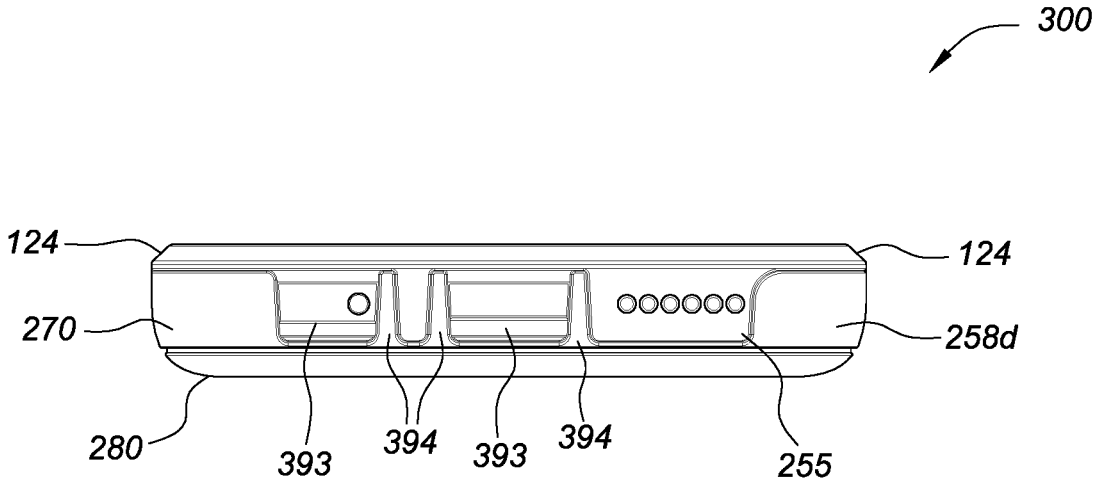
FIG. 29 is a drawing illustrating a bottom side view of the embodiment illustrated in FIG. 23.
Figure 30:
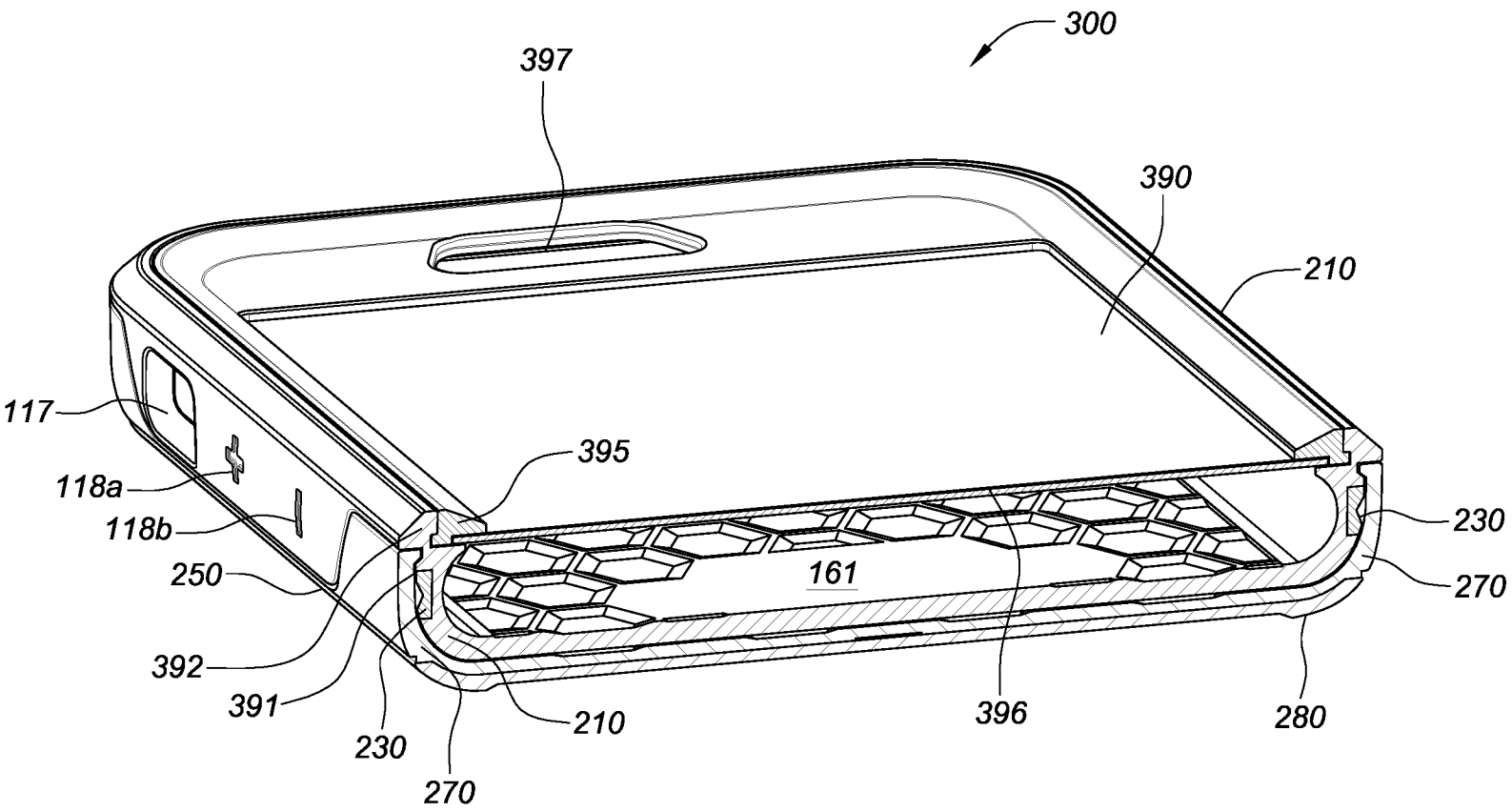
FIG. 30 is a drawing illustrating a cross-sectional perspective view taken along line A-A of the embodiment illustrated in FIG. 23.
Figure 31:
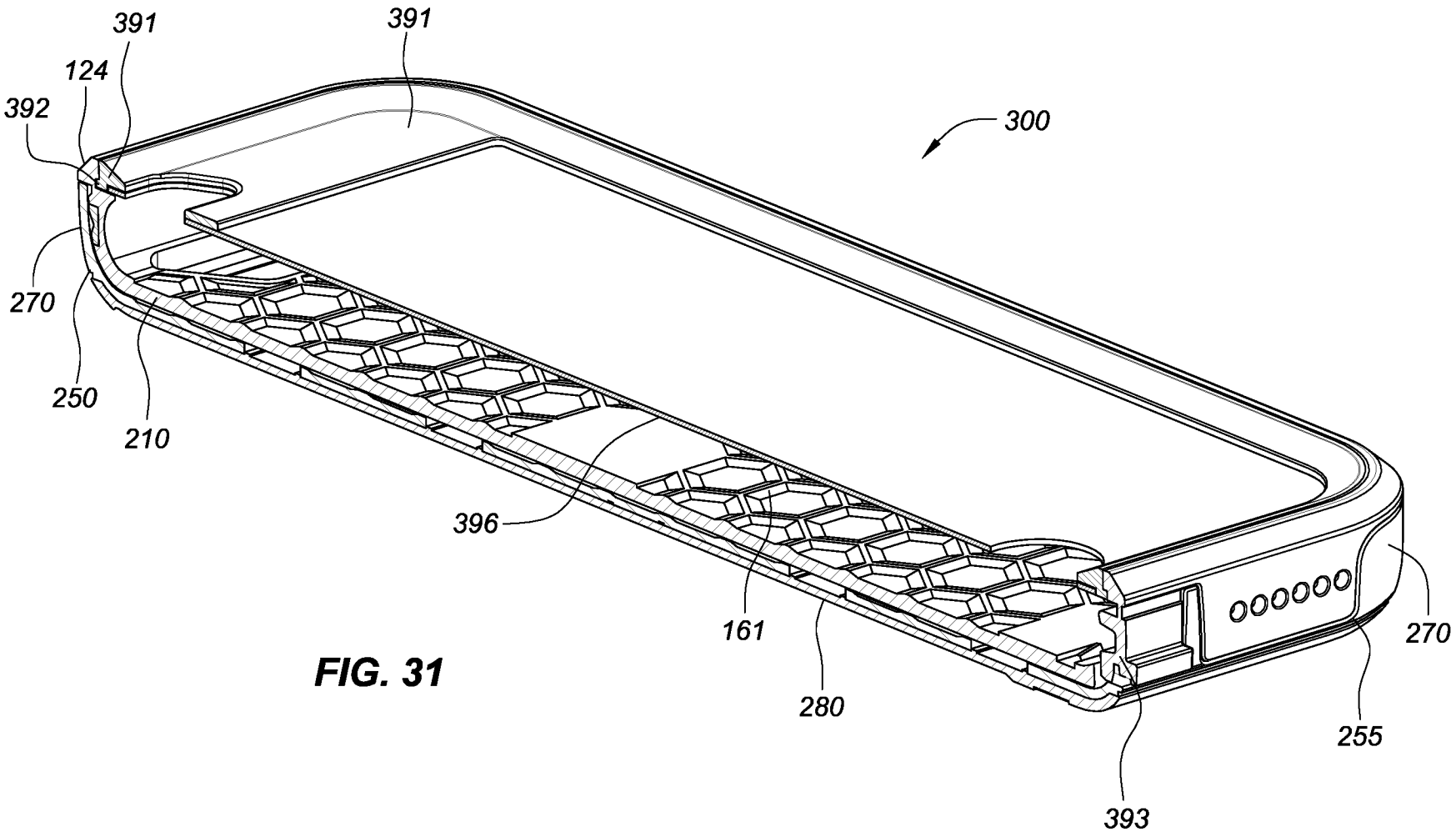
FIG. 31 is a drawing illustrating a cross-sectional perspective view taken along line B-B of the embodiment illustrated in FIG. 23.
Figure 32:
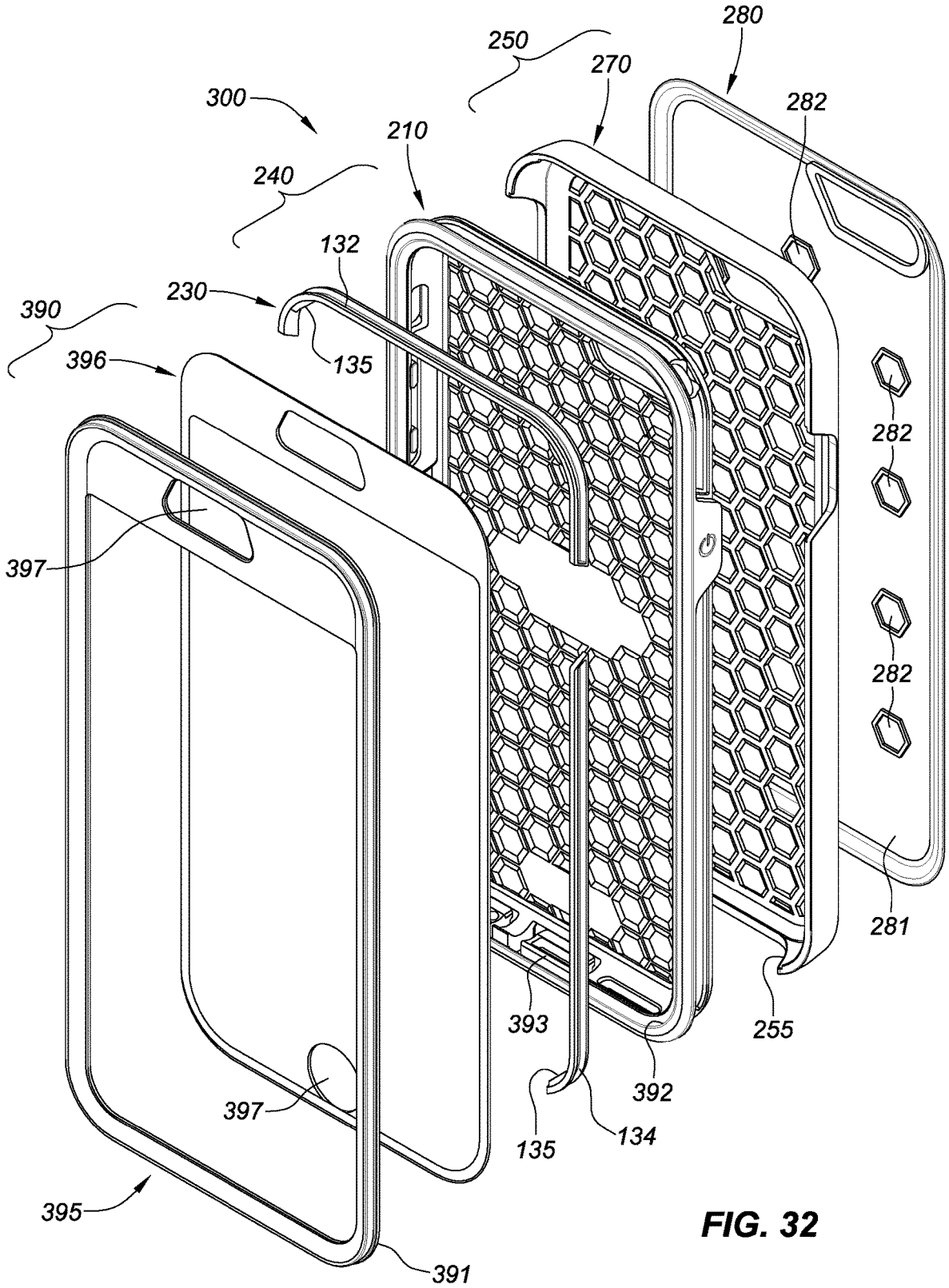
FIG. 32 is a drawing illustrating an exploded perspective view of the components that comprise the embodiment illustrated in FIG. 23.
Figure 33:
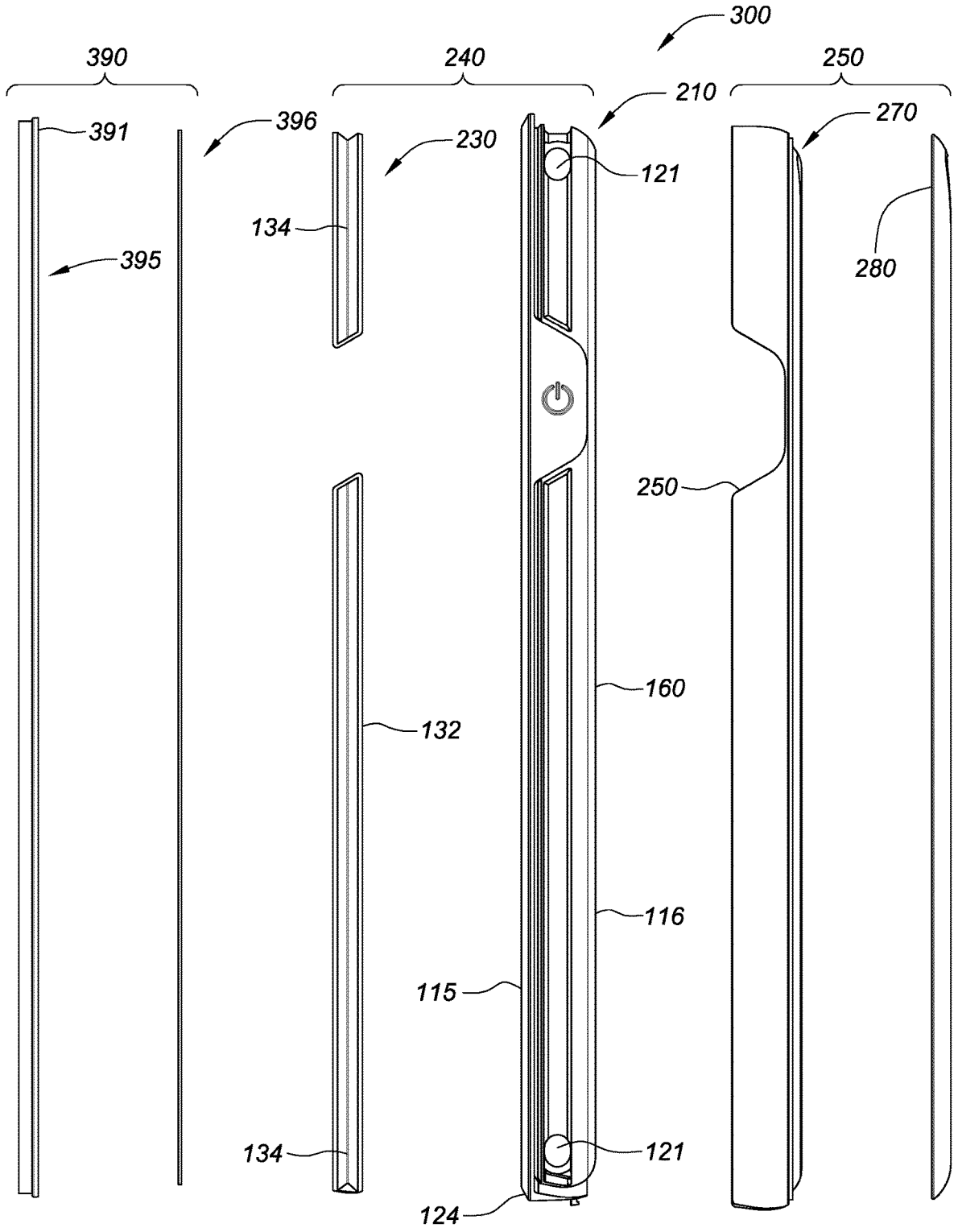
FIG. 33 is a drawing illustrating an exploded right side view of the components that comprise the embodiment illustrated in FIG. 23.

The lid panel or screen protector 390 as best illustrated in FIGS. 32-33, is comprised of a molded frame 395 that is adhered to a die cut transparent window 396. The molded frame may for example be formed of PC injected into a mold that is configured to have the shape of the frame 395. The PC material may be opaque (e.g., black or a color that matches the first molded component for example) and may include a recessed region on the inwardly facing side that is dimensioned to receive and mate with the transparent window 396. The transparent window may be made of any suitable material including a glass, tempered glass, or any suitable polymer such as polyethylene terephthalate ("PET"). When made of a transparent polymer sheet, like PET, the window can be die cut to size and adhered via a double sided tape or adhesive to the inwardly facing recessed region on the frame 395. A jig can be used to apply pressure between the frame 395 and the window 396 to assure sufficient adherence there-between. One or more apertures 397 may be formed in the screen protector 390 to facilitate user interactions with the mobile device such as the home button, proximity sensors, speakers and front facing camera features. The screen protector 390 is configured to be readily attached and detached by the user.

In operation, like the second embodiment, the user inserts the mobile device 10 into the relatively soft and flexible sleeve 240 via the major aperture 114. Once inserted, the sleeve 240 (with the mobile device contained therein) may be inserted into the shell 250 so that the protruding side wall regions in the sleeve are fitted to corresponding open-end apertures in the shell 250. The lid or screen protector 390 may be clipped or snapped into the channel 392 that is formed in the first molded component 210, either before or after the sleeve 240 is inserted into the shell 250.

While the illustrated embodiment illustrates a configuration in which the perimeter profile 391 transparent lid or screen protector 390 clips or fits into a corresponding channel 392 that is provided on the outer surface of the edge protrusion or lip 113 of the first molded component 210, it should be understood that the channel 392 be may be provided on the top edges of the wall of the shell 250 and the lid/screen protector 390 would then clip/snap or be otherwise be attached to the shell 250 as opposed to only the sleeve 240. Similarly it should be understood that the lid/screen protector 390 could have multiple protrusions at its perimeters that allow for attachment to channels in both the shell 250 and the sleeve 240.

Although the various inventive aspects are herein disclosed in the context of certain preferred embodiments, implementations, and examples, it will be understood by those skilled in the art that the present invention extends beyond the specifically disclosed embodiments to other alternative embodiments and/or uses of the invention and obvious modifications and equivalents thereof. In addition, while a number of variations of the various aspects have been shown and described in detail, other modifications, which are within their scope will be readily apparent to those of skill in the art based upon this disclosure. It should be also understood that the scope this disclosure includes the various combinations or sub-combinations of the specific features and aspects of the embodiments disclosed herein, such that the various features, modes of implementation, and aspects of the disclosed subject matter may be combined with or substituted for one another. Thus, it is intended that the scope of the present invention herein disclosed should not be limited by the particular disclosed embodiments or implementations described above, but should be determined only by a fair reading of the claims.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A protective case for a mobile device configured to be user removable from said mobile device, said protective case comprising:

a first component comprising side walls having external channels thereon, wherein said first component defines a compartment configured to receive said mobile device and wherein said compartment includes internal corner regions configured to be in contact with corner regions of said mobile device;

a second component co-molded within said external channels, wherein said first component is made of a first polymer material and said second component is made of a second polymer material that is different than said first polymer material, wherein said second polymer material is softer than said first polymer material, and wherein said second component extends through apertures in said first component to form cushion pads located at one or snore internal corner regions, wherein said cushion pads are configured to be in contact with said mobile device when said mobile device is inserted into the first component of the case; and a shell component configured to reversibly receive said first and second components, wherein said shell component is formed of a material that is more rigid than either said first or second polymer material.

2. The protective case of claim 1, wherein said first component further comprises an inner surface and an outer surface that define said side walls having an upper end region and a lower end region, and wherein a lip extends inwardly from the upper end region and defines said compartment.

3. The protective case of claim 2, wherein said lower end region is configured to extend into and form a continuous flexible back face panel, and said back face panel includes a honeycomb pattern on its inner surface defined by relatively elevated honeycomb patterned walls and recessed surfaces residing within said honeycomb patterned walls.

4. The protective case of claim 1, wherein said shell component comprises a first shell subcomponent comprising an internal side of the shell component and a second shell subcomponent comprising an external side of the shell component co-molded with said first shell subcomponent, and wherein said first shell subcomponent and said second shell subcomponent have different hardness.

5. The protective case of claim 4, wherein said first shell subcomponent is formed of PC.

6. The protective case of claim 4, wherein said second shell subcomponent is formed of TPU.

7. A protective case for a mobile device configured to be user removable from said mobile device, said protective case comprising:

a first component configured to receive said mobile device and comprising side walls having external channels thereon;

a second component co-molded within said external channels, wherein said first component is made of a first polymer material and said second component is made of a second polymer material that is different than said first polymer material, wherein said second polymer material is softer than said first polymer material, wherein said second component further comprises an inner surface and a side surface that are in contact and co-molded to said channels of said first component and, wherein said second component further comprises an exterior surface, wherein said exterior surface includes one or more second channels foamed and extending therein; and a shell component configured to reversibly receive said first and second components, wherein said shell component is formed of a material that is more rigid than either said first or second polymer material.

8. The protective case of claim 7, wherein said shell component comprises a first shell subcomponent comprising an internal side of the shell component and a second shell subcomponent comprising an external side of the shell component co-molded with said first shell subcomponent, and wherein said first shell subcomponent has a first hardness and said second shell subcomponent has a second hardness.

9. The protective case of claim 8, wherein said first hardness is greater than said second hardness.

* * * * *